US008984773B2

(12) United States Patent
Crowley, II et al.

(10) Patent No.: US 8,984,773 B2
(45) Date of Patent: Mar. 24, 2015

(54) FOOTWEAR OUTSOLE

(75) Inventors: Kevin Crowley, II, Newbury, MA (US); David M. Nau, Wayland, MA (US); James Cheney, Northboro, MA (US); Nicholas W. Wong, Lexington, MA (US)

(73) Assignee: SR Holdings, LLC, Lexington, MA (US)

( * ) Notice: Subject to any disclaimer, the term of this patent is extended or adjusted under 35 U.S.C. 154(b) by 622 days.

(21) Appl. No.: 13/213,305

(22) Filed: Aug. 19, 2011

(65) Prior Publication Data

US 2012/0180344 A1 Jul. 19, 2012

Related U.S. Application Data

(60) Provisional application No. 61/432,317, filed on Jan. 13, 2011.

(51) Int. Cl.

| | |
|---|---|
| ***A43B 13/22*** | (2006.01) |
| ***A43B 13/14*** | (2006.01) |
| ***A43B 1/00*** | (2006.01) |
| ***A43B 5/08*** | (2006.01) |
| *A43B 23/02* | (2006.01) |

(52) U.S. Cl.

CPC ..... *A43B 1/0009* (2013.01); *A43B 1/0027* (2013.01); *A43B 5/08* (2013.01); *A43B 13/223* (2013.01); *A43B 23/0225* (2013.01)

USPC ..... 36/59 C

(58) Field of Classification Search

CPC .. A43B 1/0009; A43B 1/0027; A43B 13/223; A43B 5/08; A43B 13/22

USPC ..... 36/32 R, 25 R, 59 C, 102, 103, 31; D2/951–960

See application file for complete search history.

(56) References Cited

U.S. PATENT DOCUMENTS

| | | | | |
|---|---|---|---|---|
| 1,725,347 | A | | 8/1929 | Glidden et al. |
| 3,191,321 | A | | 6/1965 | Brutting |
| 3,370,363 | A | | 2/1968 | Kaplan |
| 3,525,165 | A | | 8/1970 | Randall, Jr. |
| 4,103,439 | A | | 8/1978 | Abramson |
| D250,617 | S | | 12/1978 | Noches |
| D285,985 | S | * | 10/1986 | Tong ..... D2/955 |
| 4,670,997 | A | * | 6/1987 | Beekman ..... 36/114 |
| 4,716,663 | A | | 1/1988 | Steinhauser |

(Continued)

FOREIGN PATENT DOCUMENTS

| | | |
|---|---|---|
| CN | 2629486 Y | 8/2004 |
| DE | 2255628 | 5/1974 |

(Continued)

OTHER PUBLICATIONS

Written Opinion in PCT/US2011/052918 dated Jul. 13, 2013.

(Continued)

*Primary Examiner* — Jila M Mohandesi

(74) *Attorney, Agent, or Firm* — Warner Norcross & Judd LLP

(57) ABSTRACT

An outsole for an article of footwear. The outsole includes an outsole body having a ground contact surface and defining grooves having a sinusoidal path along the ground contact surface. The grooves are arranged to provide an edge density of between about 40 mm/cm2 and about 200 mm/cm2 and a surface contact ratio of between about 40% and about 95%.

44 Claims, 22 Drawing Sheets

(56) References Cited

U.S. PATENT DOCUMENTS

| | | | | | |
|---|---|---|---|---|---|
| D337,427 | S | * | 7/1993 | Tonkel | D2/953 |
| 5,913,592 | A | | 6/1999 | Moore | |
| 6,038,792 | A | | 3/2000 | Hauter | |
| 6,076,283 | A | * | 6/2000 | Boie | 36/59 C |
| D431,351 | S | | 10/2000 | Prats et al. | |
| D433,790 | S | * | 11/2000 | Oliver | D2/957 |
| D465,320 | S | | 11/2002 | Weege | |
| 6,523,282 | B1 | | 2/2003 | Johnston | |
| 6,681,503 | B2 | | 1/2004 | Morle | |
| D508,308 | S | | 8/2005 | Galway | |
| 7,047,668 | B2 | | 5/2006 | Burris et al. | |
| D523,624 | S | | 6/2006 | Kuerbis | |
| D532,585 | S | * | 11/2006 | McDonald | D2/959 |
| D552,333 | S | * | 10/2007 | McClaskie | D2/953 |
| 7,281,343 | B2 | * | 10/2007 | Riha et al. | 36/59 C |
| 7,347,012 | B2 | * | 3/2008 | Clark et al. | 36/50.1 |
| 7,487,605 | B2 | | 2/2009 | Hatzilias | |
| D596,385 | S | * | 7/2009 | McDade et al. | D2/953 |
| 7,562,471 | B2 | | 7/2009 | Minami | |
| D602,235 | S | | 10/2009 | Hatzilias | |
| D604,482 | S | * | 11/2009 | Fletcher | D2/917 |
| D605,385 | S | * | 12/2009 | Andersen et al. | D2/960 |
| 7,650,703 | B2 | | 1/2010 | Conolly | |
| 7,793,434 | B2 | | 9/2010 | Sokolowski et al. | |
| 7,930,841 | B2 | | 4/2011 | Luedecke et al. | |
| 7,941,946 | B2 | | 5/2011 | Clancy et al. | |
| 8,186,079 | B2 | * | 5/2012 | Carboy et al. | 36/59 C |
| 8,196,322 | B2 | | 6/2012 | Atsumi et al. | |
| 8,291,619 | B2 | * | 10/2012 | Abadjian | 36/113 |
| 2003/0167658 | A1 | | 9/2003 | Davis | |
| 2004/0055183 | A1 | | 3/2004 | Lee et al. | |
| 2005/0144812 | A1 | | 7/2005 | Wheeler | |
| 2006/0174520 | A1 | | 8/2006 | Wu | |
| 2007/0204481 | A1 | | 9/2007 | Conolly | |
| 2009/0113766 | A1 | | 5/2009 | Hooper | |
| 2010/0107449 | A1 | | 5/2010 | Minami | |
| 2010/0281714 | A1 | * | 11/2010 | Carboy et al. | 36/25 R |
| 2010/0299967 | A1 | | 12/2010 | Atsumi et al. | |
| 2010/0331122 | A1 | | 12/2010 | Morag | |

FOREIGN PATENT DOCUMENTS

| | | | |
|---|---|---|---|
| DE | 2743666 | | 3/1978 |
| DE | 2801984 | | 7/1979 |
| DE | 2827172 | | 1/1980 |
| DE | 3314274 | | 10/1983 |
| EP | 0383489 | | 8/1990 |
| EP | 0496931 | | 8/1992 |
| EP | 0948269 | | 10/1999 |
| EP | 1430801 | A1 | 6/2004 |
| ES | 2088365 | A1 | 8/1996 |
| FR | 825095 | | 2/1938 |
| FR | 2475369 | | 8/1981 |
| GB | 6995 | | 0/1901 |
| GB | 7669 | | 0/1905 |
| GB | 202859 | | 8/1923 |
| GB | 409010 | | 4/1934 |
| GB | 735712 | | 8/1955 |
| GB | 940925 | | 11/1963 |
| GB | 2248171 | | 4/1992 |
| GB | 2259639 | | 3/1993 |
| GB | 2286517 | | 8/1995 |
| GB | 2361406 | | 10/2001 |
| GB | 2430859 | | 4/2007 |
| RU | 2015675 | | 7/1994 |
| WO | 9305673 | | 4/1993 |
| WO | 9632856 | | 10/1996 |
| WO | WO-9816129 | A1 | 4/1998 |
| WO | 9825490 | | 6/1998 |
| WO | WO-2006050565 | A1 | 5/2006 |
| WO | 2007144331 | | 12/2007 |
| WO | 2010138315 | | 12/2010 |

OTHER PUBLICATIONS

International Search Report for PCT/US2011/052918 dated Apr. 4, 2012.

International Search Report for Application PCT/US2011/052936 dated Feb. 21, 2012.

PCT/US2011/052936, Written Opinion, Jan. 4, 2013.

* cited by examiner

FOOTWEAR OUTSOLE

CROSS REFERENCE TO RELATED APPLICATIONS

This U.S. patent application claims priority under 35 U.S.C. §119(e) to U.S. Provisional Application 61/432,317, filed on Jan. 13, 2011, which is hereby incorporated by reference in its entirety.

TECHNICAL FIELD

This disclosure relates to outsoles for articles of footwear.

BACKGROUND

Articles of footwear, such as shoes, are generally worn while exercising to protect and provide stability of a user's feet. In general, shoes include an upper portion and a sole. When the upper portion is secured to the sole, the upper portion and the sole together define a void that is configured to securely and comfortably hold a human foot. Often, the upper portion and/or sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability, while shape, texture, and color are used to promote the aesthetic qualities of the shoe. The sole generally provides support for a user's foot and acts as an interface between the user's foot and the ground.

SUMMARY

One aspect of the disclosure provides an outsole for an article of footwear. The outsole includes an outsole body having a ground contact surface and defining grooves having a sinusoidal path along the ground contact surface. The grooves are arranged to provide an edge density of between about 40 mm/cm$^2$ and about 200 mm/cm$^2$ and a surface contact ratio of between about 40% and about 95%.

Implementations of the disclosure may include one or more of the following features. In some implementations, at least some of the sinusoidal grooves are arranged substantially parallel to each other to provide an edge density of about 59 mm/cm$^2$ and a surface contact ratio of about 67%. In additional implementations, at least some of the sinusoidal grooves are arranged substantially parallel to each other to provide an edge density of about 106 mm/cm$^2$ and a surface contact ratio of about 91%. In yet additional implementations, at least some of the sinusoidal grooves are arranged substantially parallel to each other to provide an edge density of about 80 mm/cm$^2$ and a surface contact ratio of about 84%. At least some of the sinusoidal grooves, in some implementations, are arranged substantially parallel to each other to provide an edge density of about 77 mm/cm$^2$ and a surface contact ratio of about 90%.

At least one sinusoidal groove path along the ground contact surface may have an amplitude of between about 3 mm and about 25 mm and/or a frequency of between about 4 mm and about 50 mm. For example, at least one sinusoidal groove path along the ground contact surface may have an amplitude of between about 5 mm and a frequency of about 6.3 mm. Moreover, the corresponding groove may have a width of between about 0.1 mm and about 5 mm and/or a depth of between about 25% a thickness of the outsole and about 75% the thickness of the outsole. For example, the corresponding groove may have a width of about 0.4 mm and/or a depth of about 1.2 mm.

In some implementations, each groove has a sinusoidal groove path along the ground contact surface having an amplitude of about 5 mm and a frequency of about 6.3 mm. Adjacent grooves are offset from each other along the ground contact surface in a common direction by an offset distance of about 3.15 mm. At least one channel may connect two adjacent grooves. The at least one channel can have a depth of about half a depth of the grooves and/or a width substantially equal to a width of the grooves.

In additional implementations, at least one sinusoidal groove path along the ground contact surface has an amplitude of about 17.6 mm and a frequency of about 40 mm. The corresponding groove may have a width of about 1 mm and/or a depth of about 1.5 mm.

Each groove may have a sinusoidal groove path along the ground contact surface having an amplitude of about 17.6 mm and a frequency of about 40 mm, where adjacent grooves are offset from each other along the ground contact surface in a common direction by an offset distance of between about 3 mm and about 3.75 mm. For three consecutive grooves along the ground contact surface, a first groove may be offset from a second groove by an offset distance of about 3 mm and the second groove may be offset from a third groove by an offset distance of about 3.75 mm.

Each groove may have at least one shoulder edge with the ground contact surface. The at least one shoulder edge may define a right angle with a substantially non-radiused corner. Other shoulder edge configurations are possible as well, such as rounded, chamfered, etc.

The outsole body may comprise at least one of rubber having a durometer of between about 45 Shore A and about 65 Shore A, a rubber having a minimum coefficient of friction of about 0.9 and a durometer of between about 50 Shore A and about 65 Shore A, and a rubber having a minimum coefficient of friction of about 1.1 and a durometer of between about 50 Shore A and about 65 Shore A.

Another aspect of the disclosure provides an outsole for an article of footwear that includes an outsole body having a ground contact surface and defining grooves having a sinusoidal path along the ground contact surface. The grooves define a sinusoidal groove path along the ground contact surface having an amplitude of about 5 mm and a frequency of about 6.3 mm.

In some implementations, the grooves have a width of about 0.4 mm and/or a depth of about 1.2 mm. Adjacent grooves may be offset from each other along the ground contact surface in a common direction by an offset distance (e.g., about 3.15 mm). In some examples, the outsole includes at least one channel connecting the adjacent grooves. The at least one channel may have a depth of about half a depth of the grooves and/or a width substantially equal to a width of the grooves. Moreover, the grooves may be arranged substantially parallel to each other to provide an edge density of about 106 mm/cm$^2$ and a surface contact ratio of about 91%.

In another aspect, an outsole for an article of footwear includes an outsole body having a ground contact surface and defining grooves having a sinusoidal path along the ground contact surface. The grooves define a sinusoidal groove path along the ground contact surface having an amplitude of about 17.6 mm and a frequency of about 40 mm.

In some implementations, the grooves have a width of about 1 mm and/or a depth of about 1.5 mm. Adjacent grooves may be offset from each other along the ground contact surface in a common direction by an offset distance (e.g., between about 3 mm and about 3.75 mm). For example, for three consecutive grooves along the ground contact surface, a first groove may be offset from a second groove by an offset distance of about 3 mm and the second groove is offset from the third groove by an offset distance of about 3.75 mm.

Each groove may have at least one shoulder edge with the ground contact surface. The at least one shoulder edge may define a right angle with a substantially non-radiused corner. Moreover, at least some adjacent grooves may intersect each other periodically along their respective sinusoidal paths. The grooves can be arranged substantially parallel to each other to provide an edge density of about 59 mm/cm$^2$ and a surface contact ratio of about 67%.

In yet another aspect, an outsole for an article of footwear includes an outsole body having lateral and medial portions and a ground contact surface. The outsole defining a longitudinal axis along a walking direction and perpendicular transverse axis. The ground contact surface has a first tread region disposed on the lateral outsole body portion near a lateral periphery of the outsole, a second tread region disposed on the medial outsole body portion near a medial periphery of the outsole, and a third tread region disposed between the first and second tread regions in at least a ground striking portion of the outsole. The first and second tread regions define grooves having a sinusoidal path along the ground contact surface with an axis of propagation substantially parallel to the longitudinal axis of the outsole. Adjacent grooves are offset from each other along the transverse axis by a first offset distance. The third tread region defines grooves having a sinusoidal path along the ground contact surface with an axis of propagation substantially parallel to the transverse axis of the outsole. Adjacent grooves are offset from each other along the longitudinal axis by a second offset distance.

In some implementations, the grooves of the first and second tread regions define a sinusoidal groove path along the ground contact surface having an amplitude of about 17.6 mm and a frequency of about 40 mm. The grooves of the first and second tread regions may have a width of about 1 mm and/or a depth of about 1.5 mm. The first offset distance may be between about 3 mm and about 3.75 mm. For example, for three consecutive grooves along the ground contact surface of the first and second tread regions, a first groove is offset from a second groove by an offset distance of about 3 mm and the second groove is offset from a third groove by an offset distance of about 3.75 mm. At least some adjacent grooves of the first and second tread regions may intersect each other periodically along their respective sinusoidal paths. Moreover, the grooves of the first and second tread regions may be arranged to provide an edge density of about 59 mm/cm$^2$ and a surface contact ratio of about 67%.

The grooves of the third tread region may define a sinusoidal groove path along the ground contact surface having an amplitude of about 5 mm and a frequency of about 6.3 mm. In some examples, the grooves of the third tread region have a width of about 0.4 mm and/or a depth of about 1.2 mm. The second offset distance may be about 3.15 mm. The third tread region sometimes includes at least one channel connecting adjacent grooves. The at least one channel has a depth of about half a depth of the grooves of the third tread region and/or a width substantially equal to a width of the grooves the third tread region. The grooves of the third tread region can be arranged to provide an edge density of about 106 mm/cm$^2$ and a surface contact ratio of about 91%.

Each groove may have at least one shoulder edge with the ground contact surface. The at least one shoulder edge defines a right angle with a substantially non-radiused corner.

For each of the aspects discussed, the outsole body may comprise at least one of rubber having a durometer of between about 45 Shore A and about 65 Shore A, a rubber having a minimum coefficient of friction of about 0.9 and a durometer of between about 50 Shore A and about 65 Shore A, and a rubber having a minimum coefficient of friction of about 1.1 and a durometer of between about 50 Shore A and about 65 Shore A.

The details of one or more implementations of the disclosure are set forth in the accompanying drawings and the description below. Other aspects, features, and advantages will be apparent from the description and drawings, and from the claims.

Figure 1:
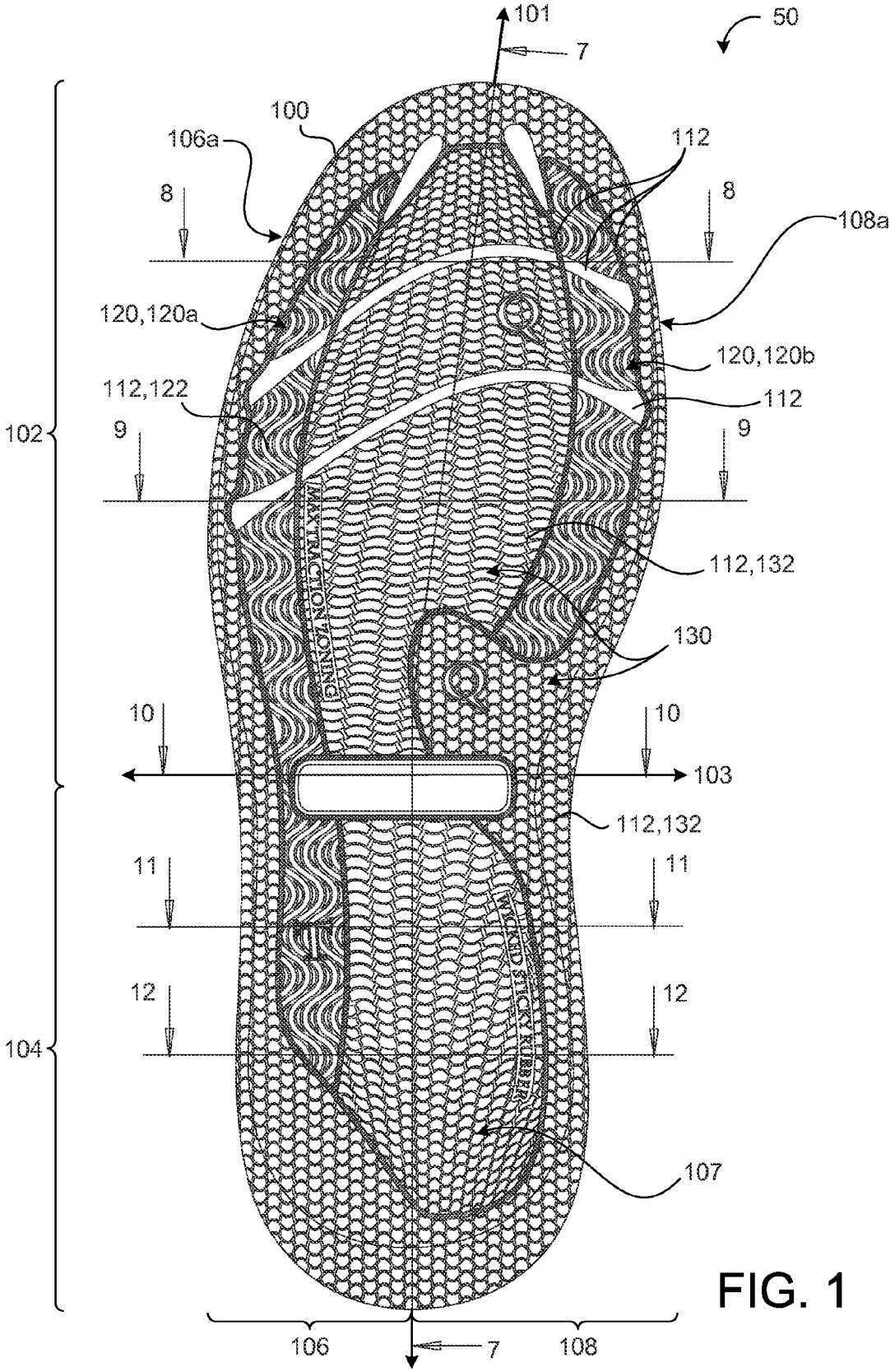
FIG. 1 is a bottom view of an exemplary sole assembly.
Figure 2:
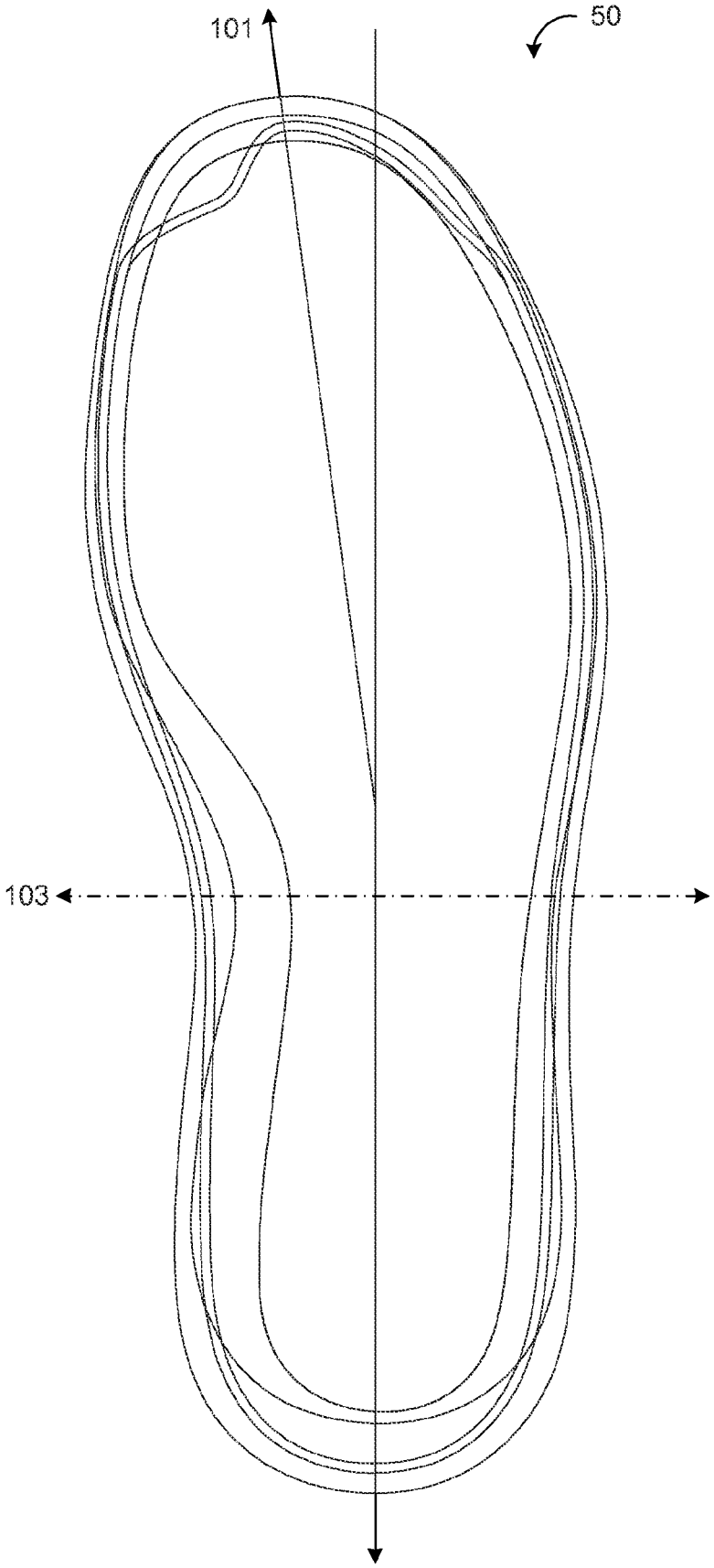
FIG. 2 is a top view of the sole assembly shown in FIG. 1.
Figure 3:
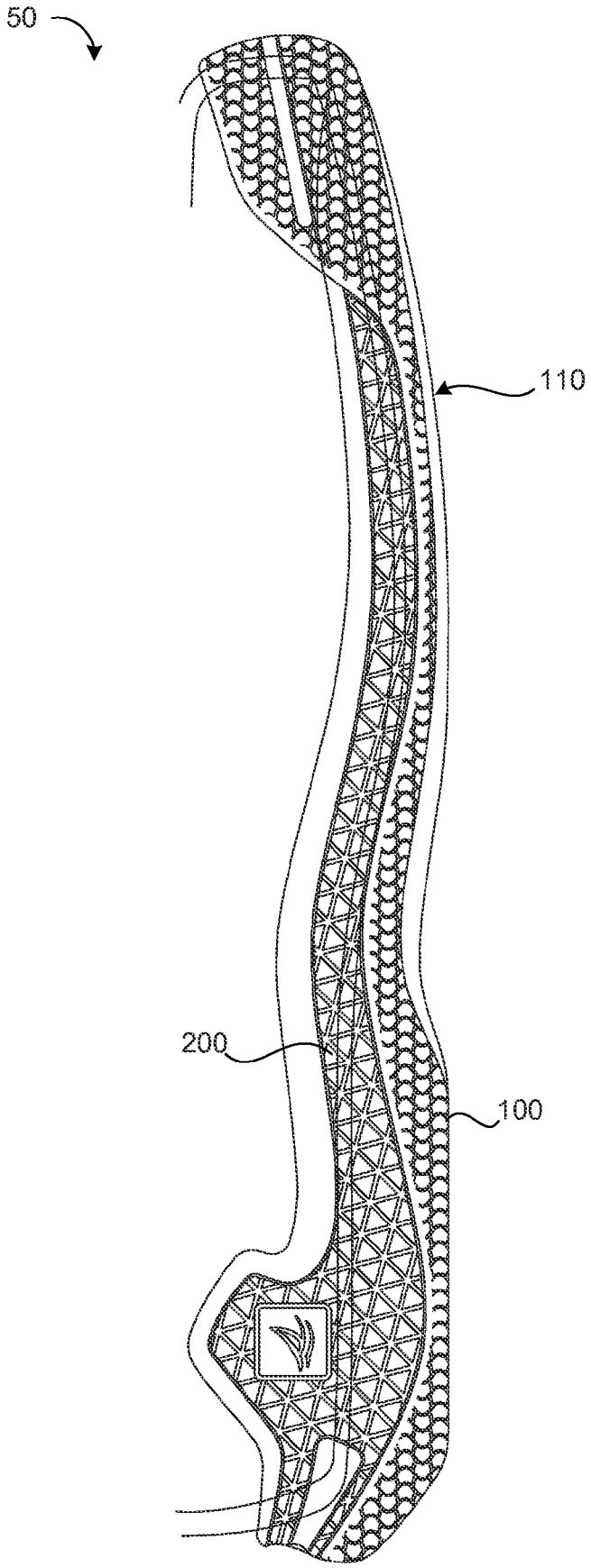
FIG. 3 is a lateral side view of the sole assembly shown in FIG. 1.
Figure 4:
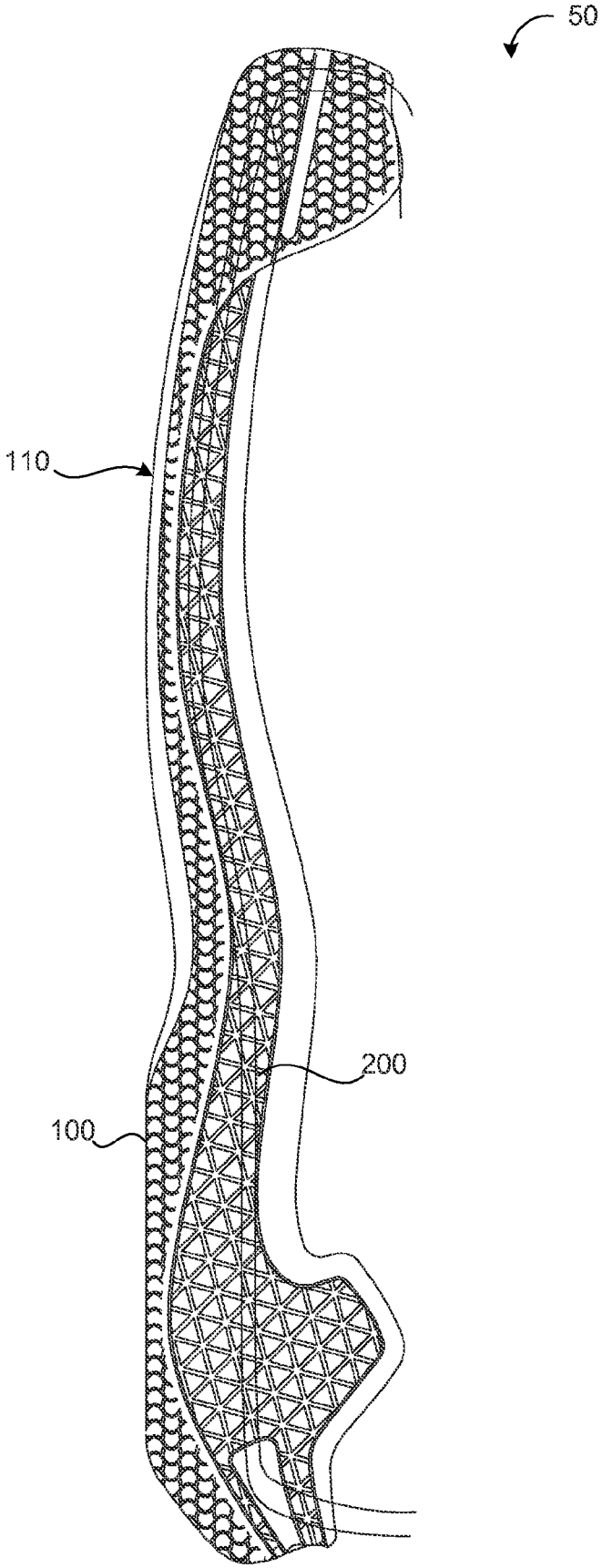
FIG. 4 is a medial side view of the sole assembly shown in FIG. 1.
Figure 5:
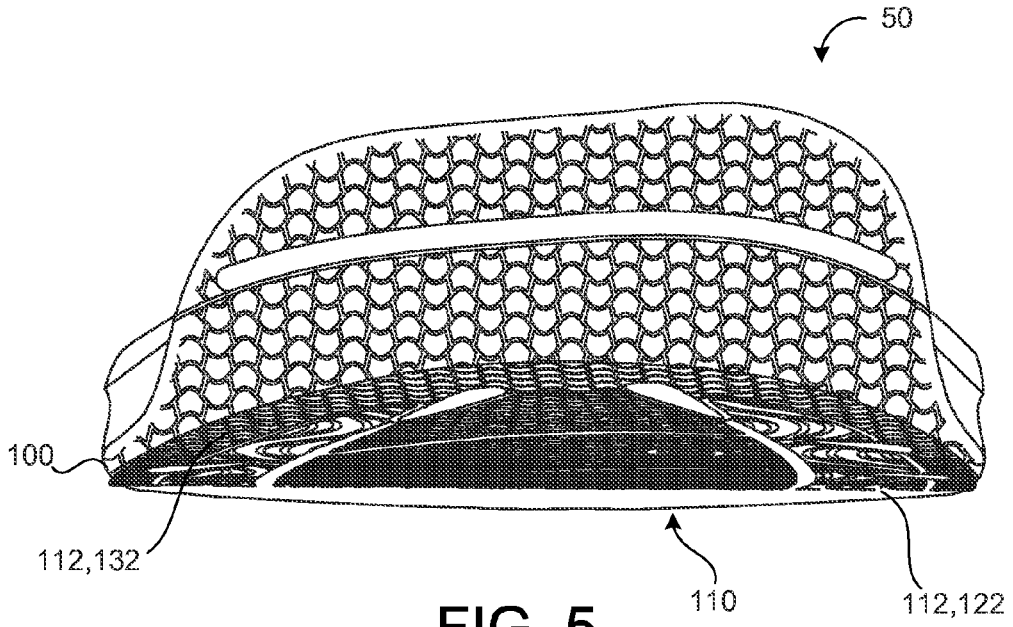
FIG. 5 is a front view of the sole assembly shown in FIG. 1.
Figure 6:
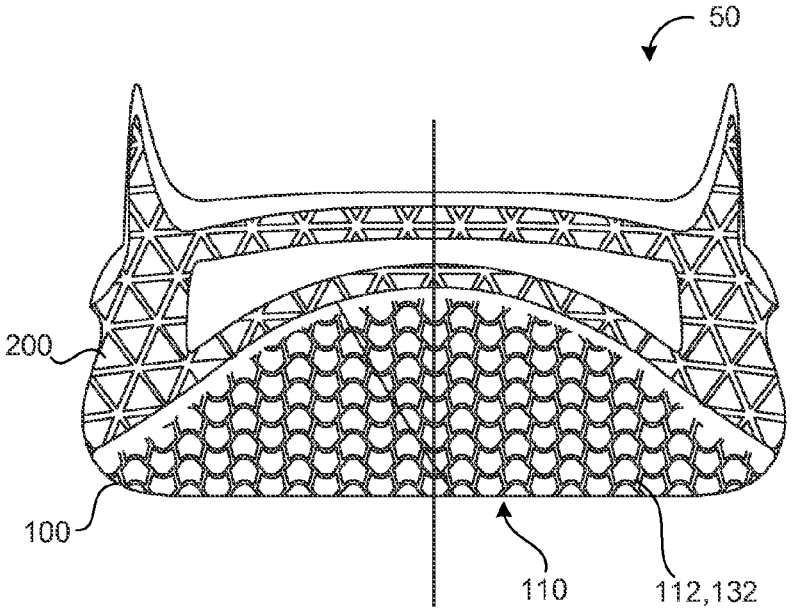
FIG. 6 is a rear view of the sole assembly shown in FIG. 1.
Figure 7:
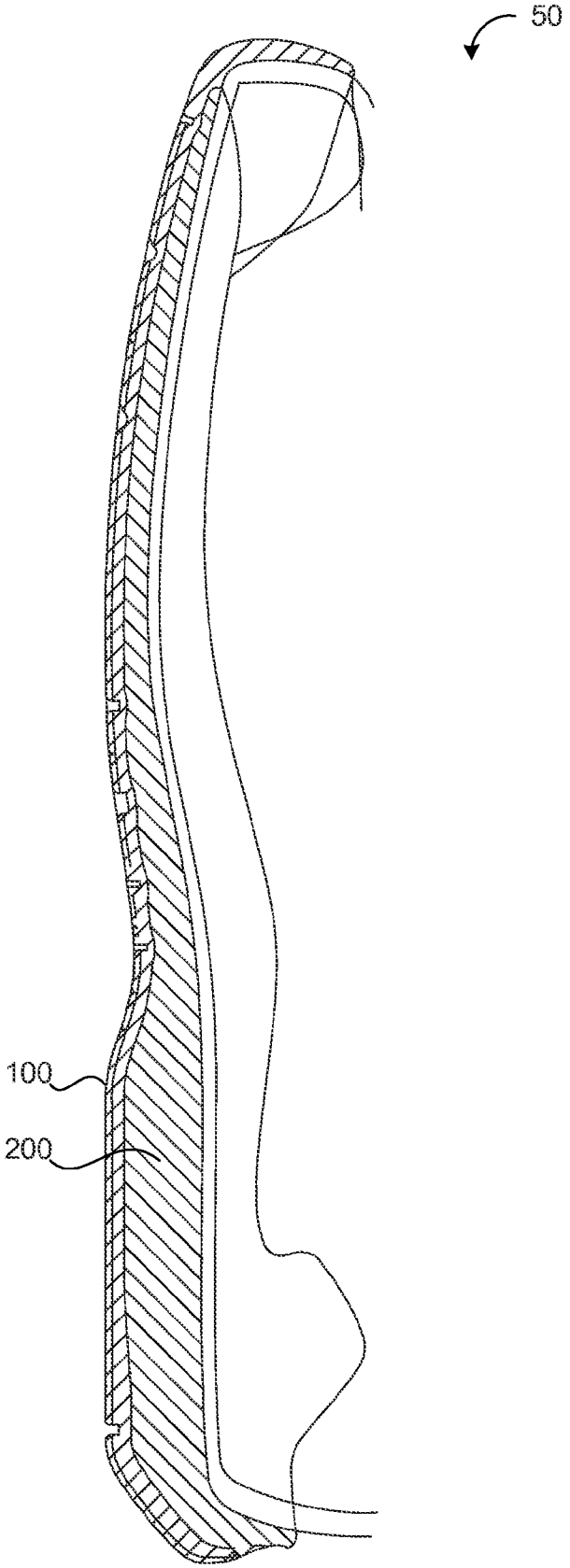
FIG. 7 is a section view of the sole assembly shown in FIG. 1 along line 7-7.
Figure 8:
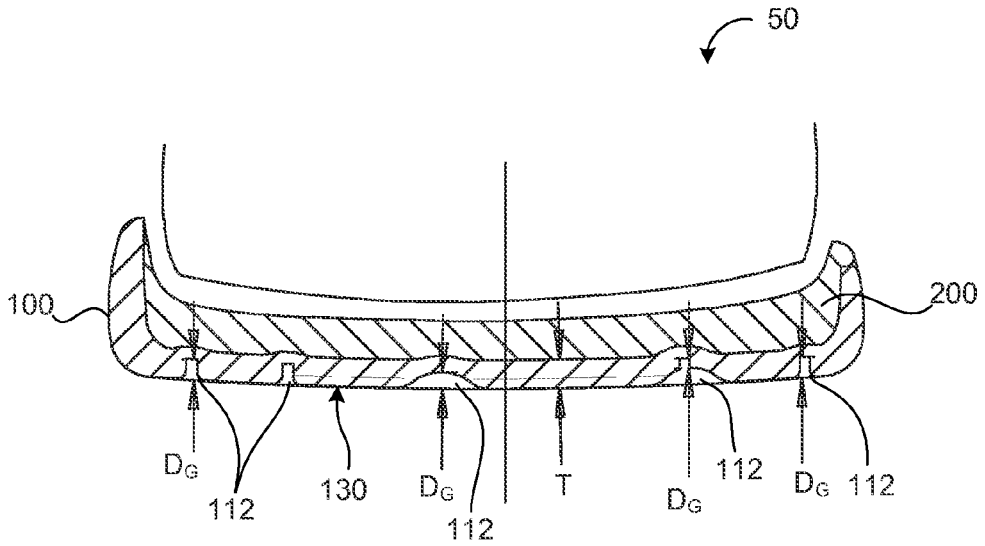
FIG. 8 is a section view of the sole assembly shown in FIG. 1 along line 8-8.
Figure 9:
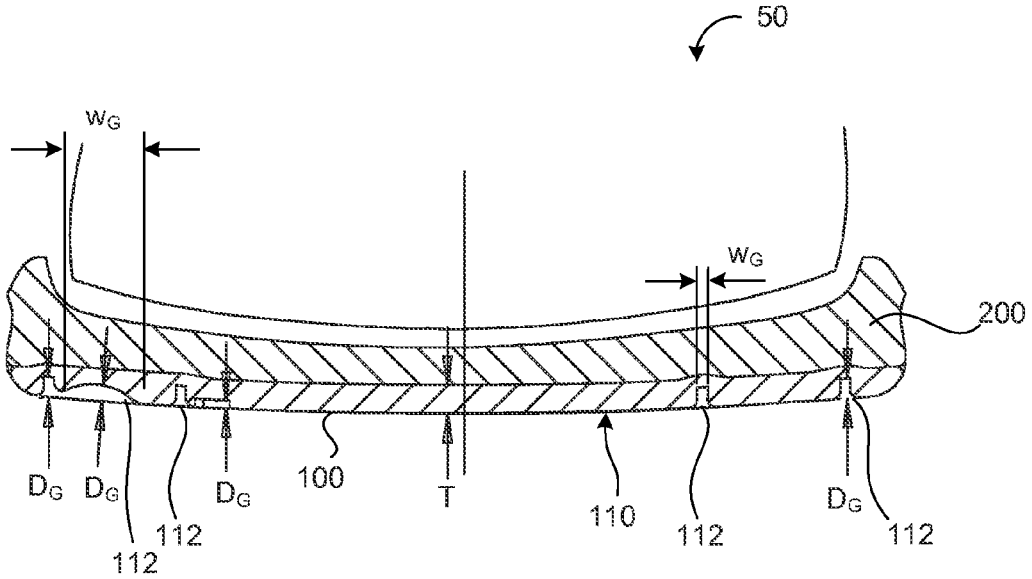
FIG. 9 is a section view of the sole assembly shown in FIG. 1 along line 9-9.
Figure 10:
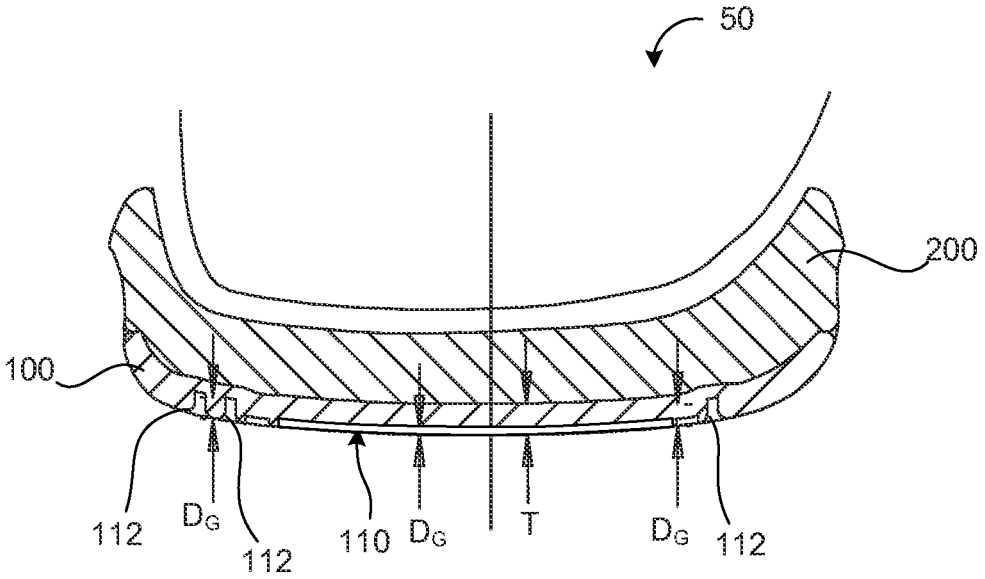
FIG. 10 is a section view of the sole assembly shown in FIG. 1 along line 10-10.
Figure 11:
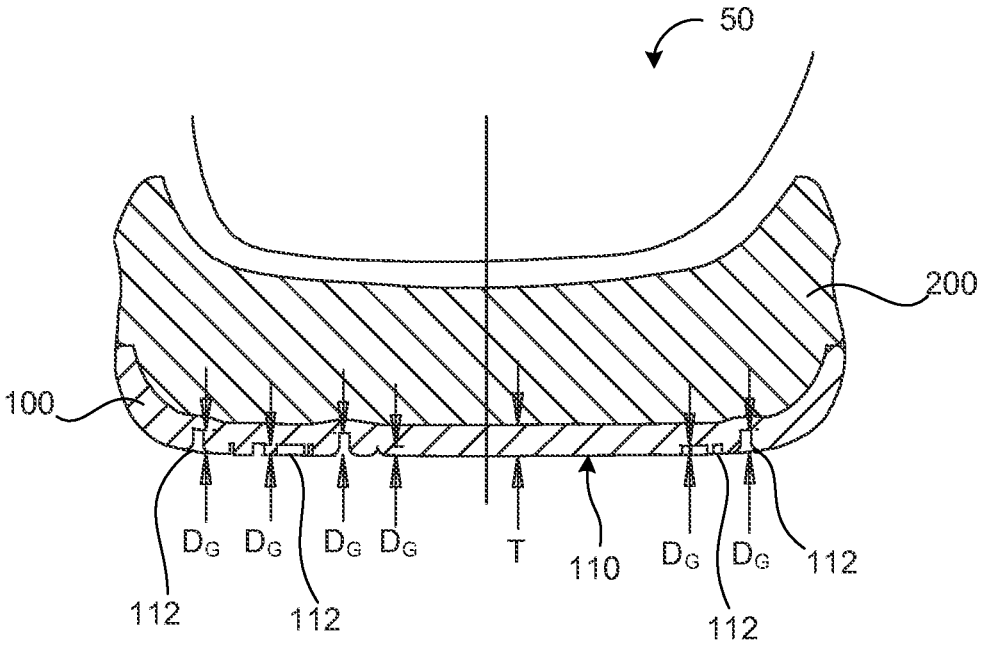
FIG. 11 is a section view of the sole assembly shown in FIG. 1 along line 11-11.
Figure 12:
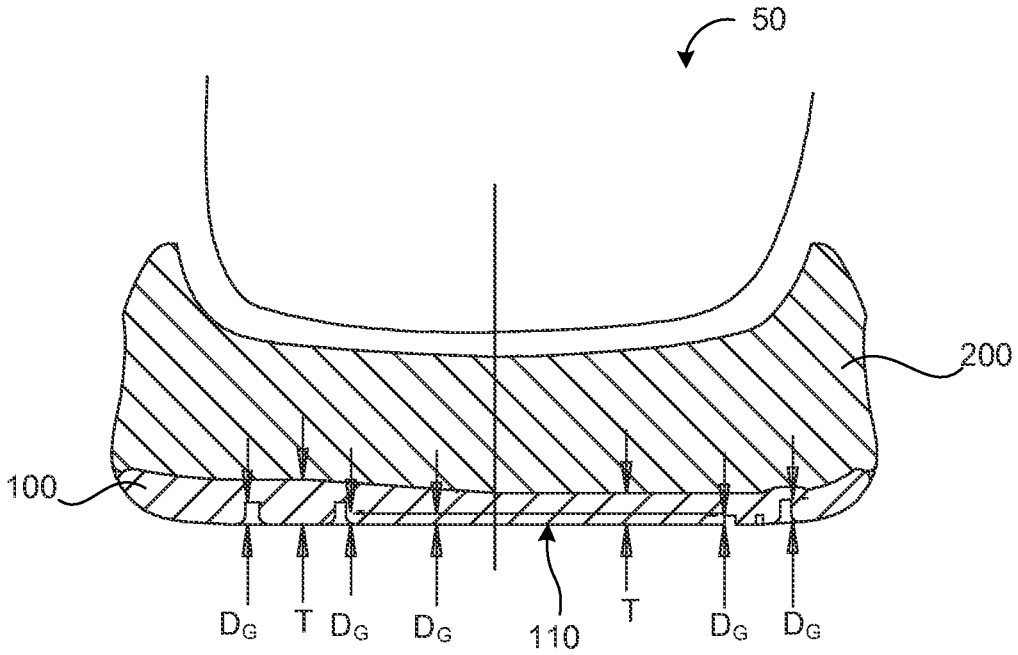
FIG. 12 is a section view of the sole assembly shown in FIG. 1 along line 12-12.

Like reference symbols in the various drawings indicate like elements. By way of example only, all of the drawings are directed to an outsole for an article of footwear (e.g., a shoe) suitable to be worn on a user's right foot. The invention includes also the mirror images of the drawings, i.e. an outsole for an article of footwear suitable to be worn on the user's left foot.

DETAILED DESCRIPTION

Referring to FIGS. 1-7, in some implementations, a sole assembly 50 includes an outsole 100 supporting a midsole 200. The outsole 100 has a forefoot portion 102, a heel portion 104 as well as a lateral portion 106 and a medial portion 108. The outsole 100 also defines a ground contact surface 110 for contacting the ground. The midsole 200 can be made of ethylene vinyl acetate (EVA), foam, or any suitable material for providing cushioning in an article of footwear.

The outsole 100 may have a tread configuration designed for slip resistance. For example, the ground contact surface 110 of the outsole 100 may define a plurality of grooves or channels 112, such as siped grooves or slits, that receive water escaping from between the ground contact surface 110 and the ground as the outsole 100 is pressed against the ground (e.g., when the sole assembly 50 bears the weight of a user). Liquid can flow in the grooves or channels 112 toward a perimeter of the outsole 100 (i.e., away from weight-bearing and contact surfaces). The grooves or channels 112 may also be configured to provide flex regions of the outsole 100, such as in the forefoot portion 102 to accommodate toe lifting of a user or flexing during walking or running. The grooves or channels 112 may be adequately sized for liquid movement there-through, while deterring the accumulation of small objects therein. Moreover, the grooves or channels 112 may flex open (e.g., during walking or running), providing traction and water escapement from the ground contact surface 110. In some implementations, the grooves or channels 112 are cut into the outsole 100, while in other implementations, the grooves or channels 112 are molded with the outsole 100. The grooves or channels 112 can have a width $W_G$ of between about 0.1 mm to about 5 mm (e.g., 1.2 mm) and/or a depth $D_G$ of between about 25% to about 75% of a thickness T of the outsole 100. For example, for an outsole 100 having a thickness of 3.5 mm, the grooves 112 can have a depth D of between about 0.8 mm and about 2.6 mm (e.g., a depth D of 1 mm, 2 mm, or 2.5 mm). Siped grooves 112 may have a relatively thin width $W_G$ as compared to other types of grooves 112. Siped grooves 112 may be formed by razor cutting the groove 112 into the outsole 100 or molding the groove 112 with a relatively narrow width $W_G$.

In the examples shown, the outsole 100 defines first and second tread regions 120, 130; however, the outsole 100 may define one contiguous tread region or many tread regions arranged randomly or in specific locations on the ground contact surface 130. Each tread region 120, 130 includes a corresponding configuration grooves or channels 122, 132 that provides traction on wet or slippery surfaces. The groove or channel configuration can be arranged to have a certain edge density and a certain surface contact ratio to provide a certain level of traction performance (or resistance to slip). Edge density can be defined as a length of surface edges of the ground contact surface 110 (e.g., the cumulative length (millimeters) of edges on the ground contact surface 110 from the grooves or channels 122, 132) within a square centimeter. In general, the greater the edge density, the greater the traction; however, manufacturability, aesthetics, resistance to wear and other factors may limit the edge density. The surface contact ratio can be defined as an overall area of the ground contact surface 110 minus a groove area of the ground contact surface 110 (i.e. an area of the ground contact surface removed for the grooves or channels 122, 132) divided by the overall area of the ground contact surface 110. In dry conditions, a surface contact ratio of 100% can provide the best traction; however, a ground contact surface 110 with no grooves or channels 122, 132 provides very poor traction or slip resistance in wet conditions. Therefore, a relationship or balance between the edge density and the surface contact ratio of the ground contact surface 110 can provide certain traction and performance characteristics of the outsole 100 in various environmental conditions.

The grooves or channels 112, 122, 132 of the outsole 100 can be arranged to provide an edge density of between about 40 mm/cm$^2$ and about 200 mm/cm$^2$ and/or a surface contact ratio of between about 40% and about 95%. In some implementations, the grooves or channels 112, 122, 132 of the outsole 100 are arranged to provide an edge density of between about 100 mm/cm$^2$ and about 110 mm/cm$^2$ and/or a surface contact ratio of between about 50% and about 95%. Moreover, the grooves or channels 122, 132 can define a sinusoidal path along the ground contact surface 110. For example, the sinusoidal path of the grooves or channels 122, 132 may be defined by the following equation:

$$y(t)=A\cdot\text{sine}(\omega t+\phi) \quad (1)$$

where t is time, A is amplitude, ω is angular frequency and ϕ is phase at a time of t=0. Referring to FIGS. 1-7 and 15-17, a tread pattern for the outsole 100 may include grooves 112, 122, 132 having one or more of the parameters provided in Table 1.

TABLE 1

| Parameter | Value |
|---|---|
| Edge Density | 40-200 mm/cm$^2$ |
| Surface Contact Ratio | 40%-90% |
| Amplitude (A) of Sinusoidal Path | 3 mm-25 mm |
| Frequency (ω) of Sinusoidal Path | 4 mm-50 mm |
| Groove Offset ($O_G$) | 2 mm-5 mm |
| Groove Width ($W_G$) | 0.1 mm-5 mm |
| Groove Depth ($D_G$) | 25-75% of outsole thickness |

TABLE 1-continued

| Parameter | Value |
|---|---|
| Groove Edge Angle ($\alpha$) | 75°-150° |
| Outsole Compound Durometer | 45-65 Shore A |

Referring to FIGS. 13-17, in some examples, the sinusoidal path of a groove 122, 132 has an amplitude and frequency that provides a substantially symmetric shape (e.g., a one-to-one ratio). Adjacent wave grooves or channels 122, 132 can be arranged as close as possible, providing a relatively high edge density. Moreover, a width $W_T$, $W_Q$ of the grooves or channels 122, 132 can be maintained as small as possible (e.g., via razor siping) to provide a relatively large surface contact ratio of the ground contact surface 110. In some examples, the grooves or channels 122 can each have a width $W_T$, $W_Q$ of between about 0.1 mm and about 1 mm (e.g., 0.5 mm) and a depth $D_T$, $D_Q$ of between about 25% and about 75% of a thickness T of the outsole 100. For example, for an outsole 100 having a thickness of 3.5 mm, the grooves or channels 122, 132 can have a depth $D_T$, $D_Q$ of between about 0.8 mm and about 2.6 mm (e.g., a depth D of 1 mm, 1.5 mm, 2 mm, or 2.5 mm).

Referring to FIGS. 1-17, in some implementations, the first and second tread regions 120, 132 define grooves or channels 122, 132 in wave configurations (e.g., sine waves). In the example shown in FIGS. 8-12, the grooves or channels 122, 132 can each define a corresponding shoulder 123, 133 (FIGS. 13-17) that defines a right angle or substantially at right angle (e.g., a non-radiused, non-chamfered corner or a minimally radiused corner for mold release). Other shoulder configurations are possible as well. The right angle edge style shoulder 123, 133 provides a traction edge for slip resistance. A sharp corner edge provides relatively better traction over a rounded corner, since the sharp edge can catch on surface features of the ground. As the outsole 100 flexes, each shoulder or edge 123, 133 can grab the ground for traction. Each shoulder or edge 123, 133 within a square centimeter can be counted for determining the edge density of that corresponding region of the outsole 100.

Figure 13:
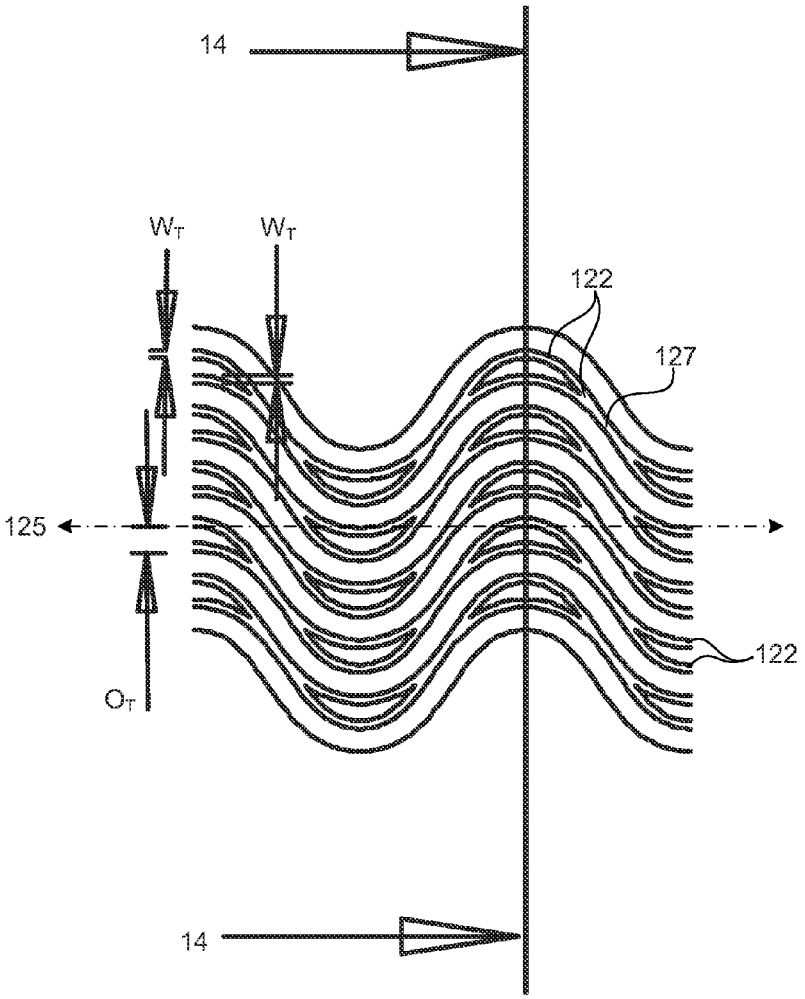
FIG. 13 is a bottom view of a portion of an exemplary outsole having sinusoidal grooves.
Figure 14:
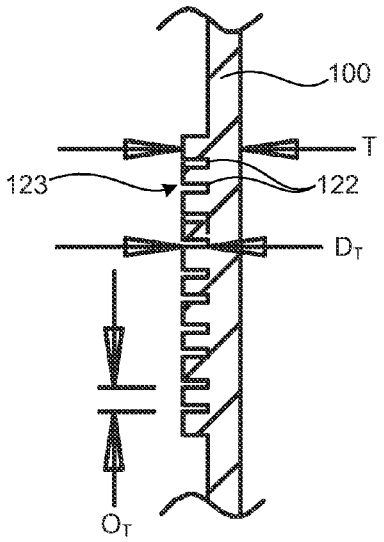
FIG. 14 is a section view of the outsole shown in FIG. 13 along line 14-14.
Figure 15:
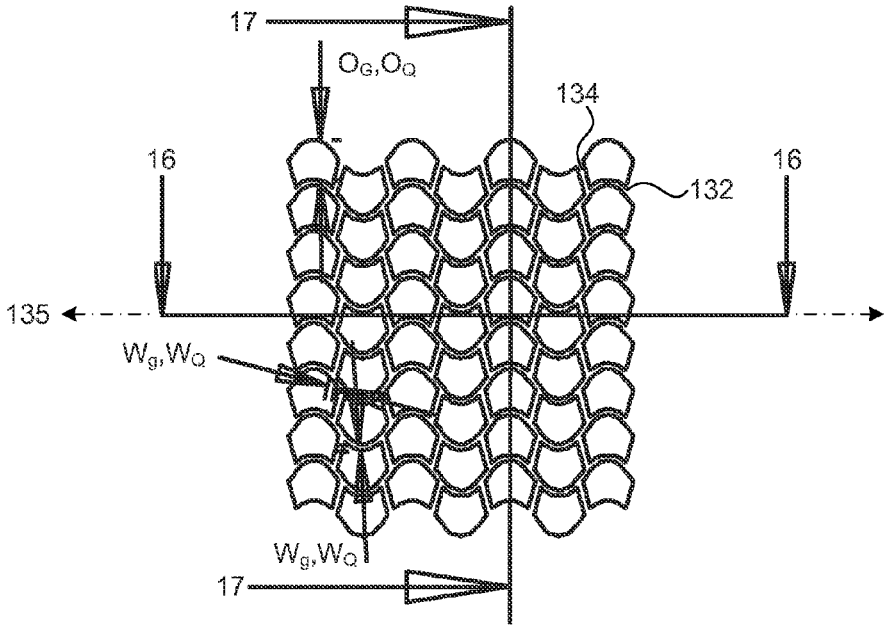
FIG. 15 is a bottom view of a portion of an exemplary outsole having sinusoidal grooves.
Figure 16:
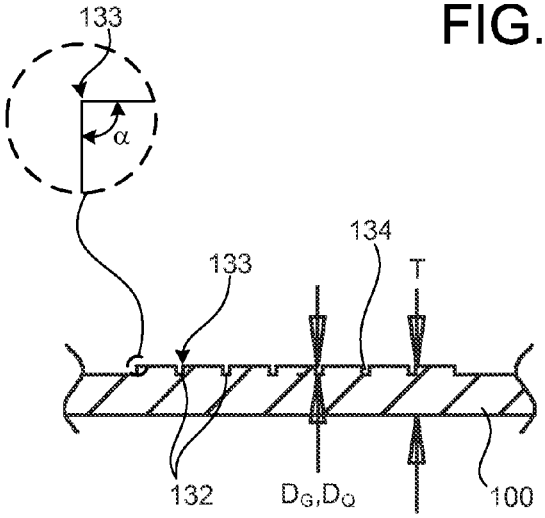
FIG. 16 is a section view of the outsole shown in FIG. 15 along line 16-16.
Figure 17:
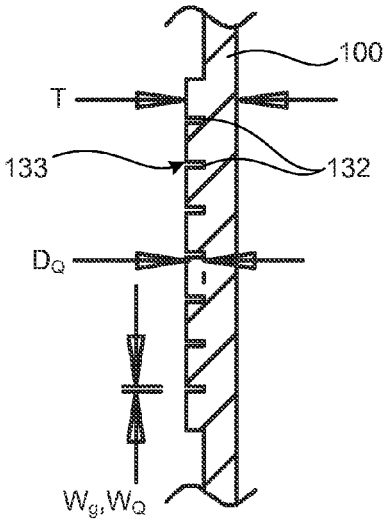
FIG. 17 is a section view of the outsole shown in FIG. 15 along line 17-17.

Referring to FIGS. 1, 13 and 14, in some implementations, the first tread region 120 defines grooves or channels 122 propagating in a wave pattern with an axis of propagation 125 (FIG. 13) substantially parallel to a longitudinal axis 101 of the outsole 100. The first tread region 120 provides traction for lateral movements of the outsole 100 against the ground, such as side-to-side movements by a user. The groove or channel arrangement places a relatively longer leading edge 123 of each groove or channel 122 perpendicular to a direction of slip, thus providing slip resistance against forces substantially parallel to a transverse axis 103 of the outsole 100. In the example shown, the outsole 100 includes a lateral first tread region 120*a* and a medial first tread region 120*b* disposed on corresponding lateral and medial portions 106, 108 of the outsole 100. The lateral first tread region 120*a* can be arranged near a lateral perimeter 106*a* of the outsole 100 and the medial first tread region 120*b* can be arranged near a medial perimeter 108*a* of the outsole 100. The second tread region 130 can be arranged between the lateral first tread region 120*a* and the medial first tread region 120*b* in at least a ground striking portion 107 of the outsole 100 (e.g., substantially under the heel and metatarsal of a user's foot). As a user moves side-to-side, weight can be placed on the respective lateral and medial portions 106, 108 of the outsole 100. The respective lateral and medial first tread regions 120*a*, 120*b* can provide traction or slip resistance against forces incurred by the ground contact surface 130 along the transverse axis 103 of the outsole 100.

In some examples, each grooves or channels 122 follows a sinusoidal path with an amplitude of about 8.8 mm (or 8.8 mm+/−1 or 2 mm) and an angular frequency of about 20 mm (or 20 mm+/−3 mm). Each grove or channel 122 can have a width $W_T$ of about 0.5 mm and/or a depth $D_T$ of about 1.5 mm. The outsole 100 can have thickness T of about 3.5 mm in the first tread region 120. In some implementations, the axis of propagation 125 of each grove or channel 122 is offset from the axis of propagation 125 of an adjacent grove or channel 122 by an offset distance $O_T$ of between about 1 mm and about 2 mm. Adjacent grooves or channels 122 can be arranged such that their corresponding groove paths merge at various or periodic groove intersections 127. The first tread region 120 may have an edge density of groove edges 123 of about 124 mm/cm$^2$ and a surface contact ratio of about 65%.

Referring to FIGS. 1 and 15-17, in some implementations, the second tread region 130 defines grooves 132 propagating in a wave pattern with an axis of propagation 135 (FIG. 15) substantially parallel to the transverse axis 103 of the outsole 100. The second tread region 130 provides traction for forward and rearward movements of the outsole 100 against the ground along a walking direction of the user. The groove arrangement places a relatively longer leading edge 123 of each groove 122 perpendicular to a direction of slip, thus providing slip resistance against forces on the ground contact surface 130 substantially parallel to the longitudinal axis 101 of the outsole 100 (as during walking or running along a normal walking direction (forward or reverse)).

In some examples, each grooves 132 follows a sinusoidal path with an amplitude of 5 mm (or 5 mm+/−1 or 2 mm) and an angular frequency of 6.3 mm (or 6.3 mm+/−1 or 2 mm). Each grove 132 can have a width $W_Q$ of about 0.4 mm, a depth $D_Q$ of about 1.2 mm. The outsole 100 can have thickness T of about 4 mm in the second tread region 130. In some implementations, the axis of propagation 135 of each grove 132 is offset from the axis of propagation 135 of an adjacent grove 132 by an offset distance $O_Q$ of between about 1.5 mm and about 3.5 mm (e.g., about 2.75 mm). Moreover, branch or cross-linking grooves 134 can interconnect adjacent grooves 132 (e.g., every quarter or half a wavelength of the sinusoidal grooves 132). In some examples, the branch grooves 134 extend in a direction substantially parallel to or at a relatively small angle (e.g., between about 1° and about 45°) with respect to the longitudinal axis 101. The branch grooves 134 may have a width $W_Q$ of about 0.4 mm, a depth $D_Q$ of about 0.6 mm (or about half the depth $D_Q$ of the other grooves and siping 132). The second tread region 130 may have an edge density of siping edges 133 of about 106 mm/cm$^2$ and a surface contact ratio of about 91%.

Figure 18A:
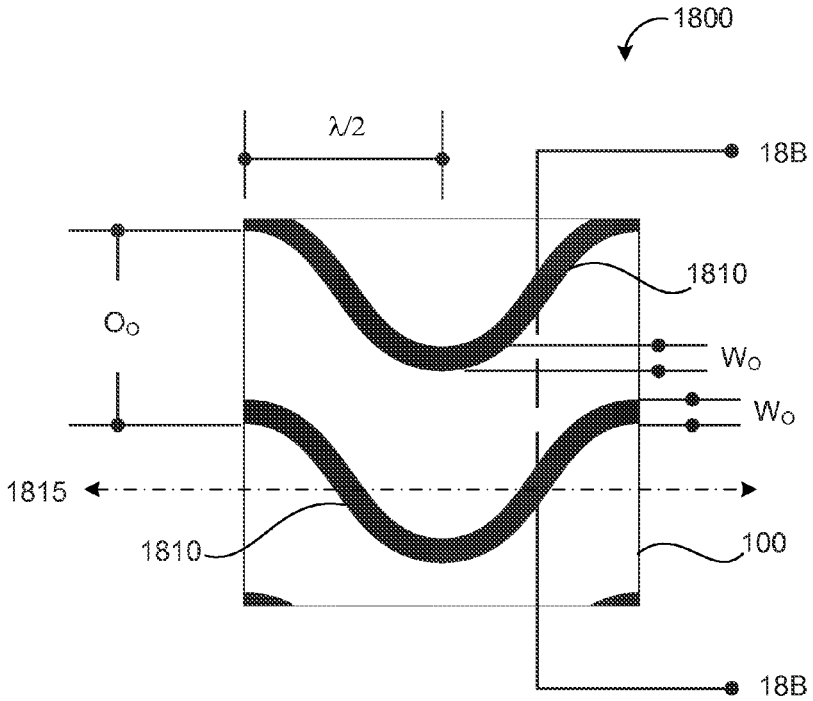
FIG. 18A is a bottom view of a portion of an exemplary outsole having sinusoidal grooves.
Figure 18B:
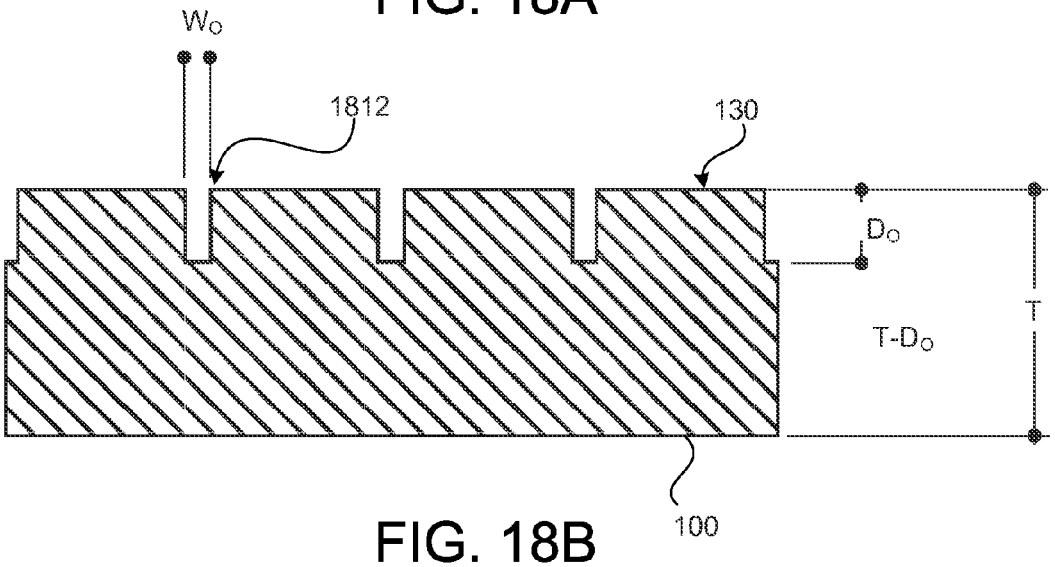
FIG. 18B is a section view of the outsole shown in FIG. 18A along line 18B-18B.

FIGS. 18A-22B depict a number of outsole tread patterns. FIGS. 18A and 18B illustrate a first tread pattern 1800 for the outsole 100 that includes grooves 1810 having a sinusoidal path along the ground contact surface 130 and equally spaced parallel to each other in a common direction. Each groove 1810 may have an amplitude A of about 5 mm, a frequency $\omega$ of about 6.3 mm, a width $W_O$ of about 0.4 mm, and/or a depth $D_O$ of about 1.2 mm. Moreover, the groove 1810 can have a wavelength $\lambda$ of about 6.3 mm. Each groove 1810 can be formed or cut to have a shoulder 1813 that defines right angle or substantially a right angle (e.g., a non-radiused, non-chamfered corner or a minimally radiused corner for mold release). The right angle edge style shoulder 1812 provides a traction edge for slip resistance. A sharp corner edge provides relatively better traction over a rounded corner. An axis of propagation 1815 of each groove 1810 can be offset from the axis of propagation 1815 of an adjacent groove 1810 by an offset distance $O_Q$ of about 3.15 mm. The outsole 100 may have a thickness T of about 4 mm. The first tread pattern 1800 may have an edge density (e.g., of shoulder edges 1812) of about 79.5 mm/cm$^2$ and a surface contact ratio of about 84%.

Figure 19A:
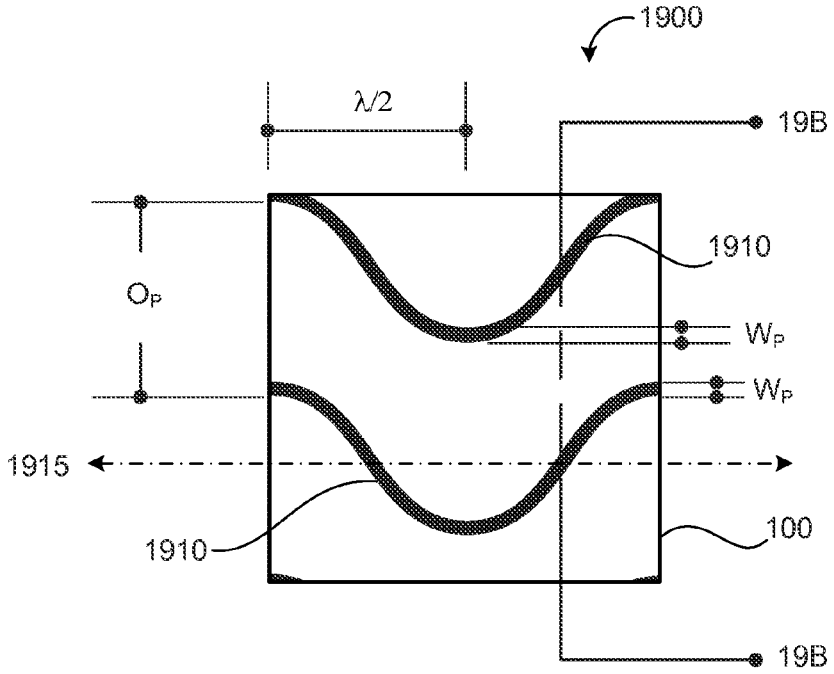
FIG. 19A is a bottom view of a portion of an exemplary outsole having sinusoidal grooves.
Figure 19B:
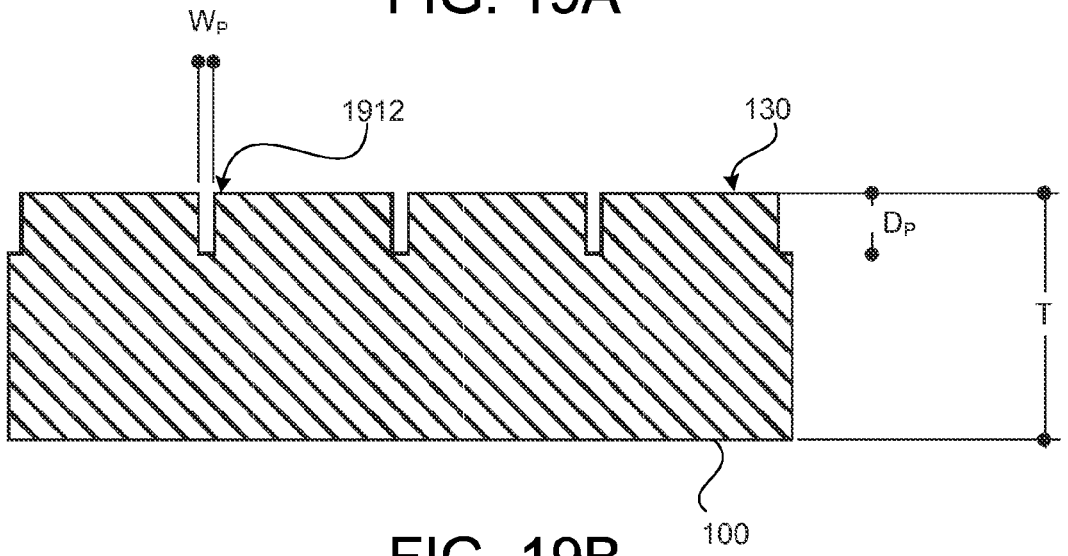
FIG. 19B is a section view of the outsole shown in FIG. 19A along line 19B-19B.

FIGS. 19A and 19B illustrate a second tread pattern 1900 for the outsole 100 that includes grooves 1910 having a sinusoidal path along the ground contact surface 130 and equally spaced parallel to each other in a common direction. Each groove 1910 may have an amplitude A of about 5.25 mm, a frequency ω of about 6.3 mm, a width $W_P$ of about 0.25 mm, and/or a depth $D_P$ of about 1.2 mm. Moreover, the groove 1910 can have a wavelength λ of about 6.3 mm. Each groove 1910 can be formed or cut to have a shoulder 1912 that defines right angle or substantially a right angle (e.g., a non-radiused, non-chamfered corner or a minimally radiused corner for mold release). An axis of propagation 1915 of each groove 1910 can be offset from the axis of propagation 1915 of an adjacent groove 1910 by an offset distance $O_P$ of about 3 mm. The outsole 100 may have a thickness T of about 4 mm. The second tread pattern 1900 may have an edge density (e.g., of shoulder edges 1912) of about 77 mm/cm$^2$ and a surface contact ratio of about 90.5%.

Figure 20A:
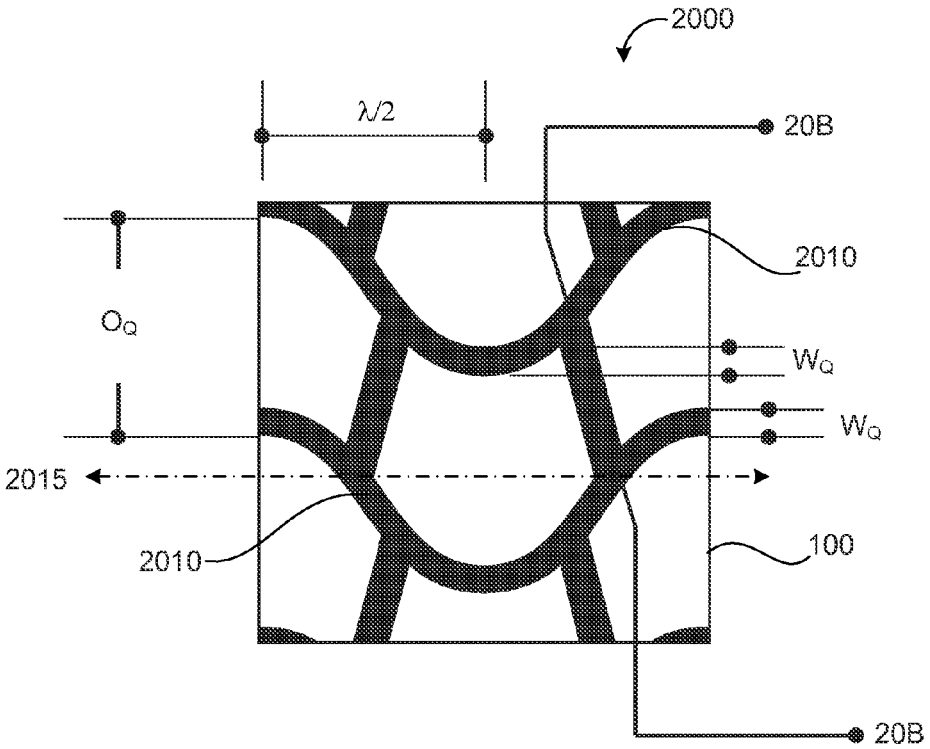
FIG. 20A is a bottom view of a portion of an exemplary outsole having sinusoidal grooves.
Figure 20B:
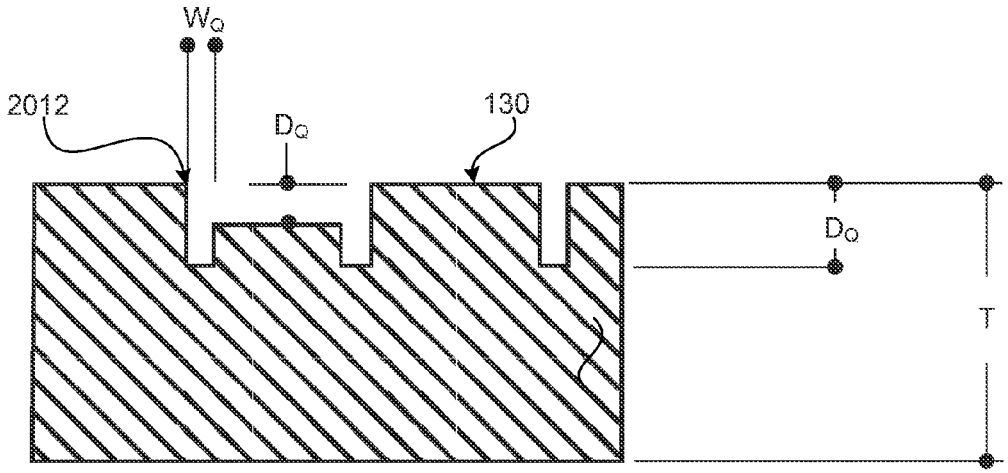
FIG. 20B is a section view of the outsole shown in FIG. 20A along line 20B-20B.

FIGS. 20A and 20B illustrate a third tread pattern 2000 for the outsole 100 that includes grooves 2010 having a sinusoidal path along the ground contact surface 130 and equally spaced parallel to each other in a common direction. Each groove 2010 may have an amplitude A of about 5 mm, a frequency ω of about 6.3 mm, a width $W_Q$ of about 0.4 mm, and/or a depth $D_Q$ of about 1.2 mm. Moreover, the groove 2010 can have a wavelength λ of about 6.3 mm. Each groove 2010 can be formed or cut to have a shoulder 2012 that defines right angle or substantially a right angle (e.g., a non-radiused, non-chamfered corner or a minimally radiused corner for mold release). An axis of propagation 2015 of each groove 1910 can be offset from the axis of propagation 2015 of an adjacent groove 2010 by an offset distance $O_Q$ of about 3.15 mm. The outsole 100 may have a thickness T of about 4 mm. Cross-linking grooves 1014 connecting adjacent grooves 1812 may have a width $W_Q$ of about 0.4 mm, and a depth $D_Q$ of about 0.6 mm. The third tread pattern 2000 may have an edge density (e.g., of shoulder edges 2012) of about 106 mm/cm$^2$ and a surface contact ratio of about 91%.

Figure 21A:
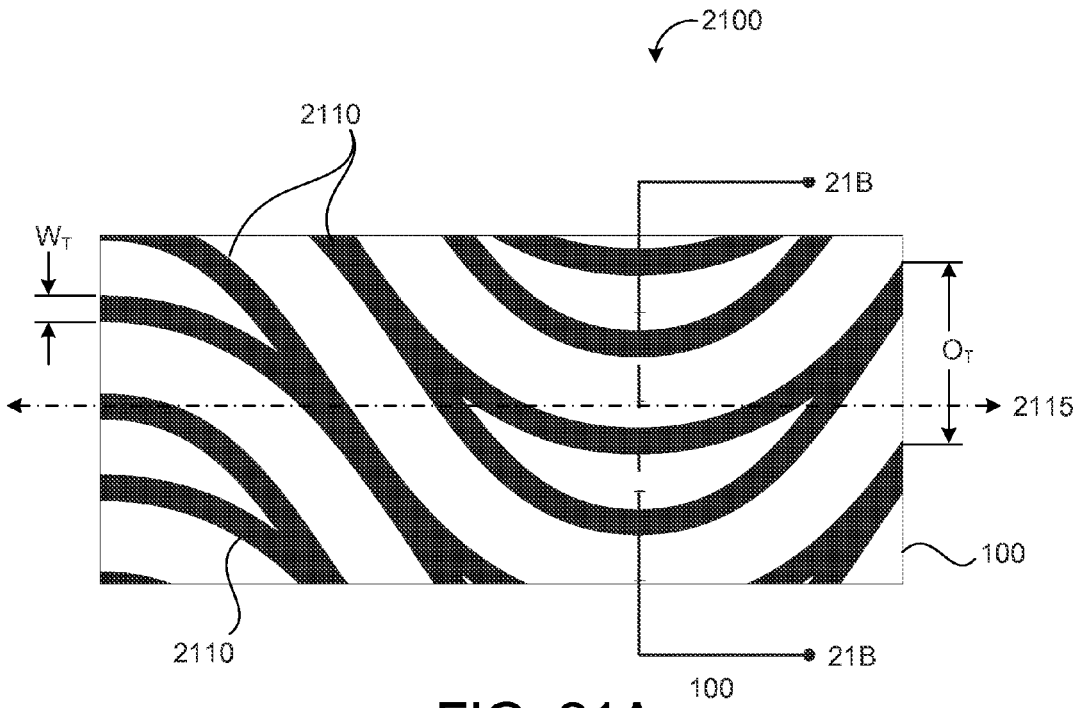
FIG. 21A is a bottom view of a portion of an exemplary outsole having sinusoidal grooves.
Figure 21B:
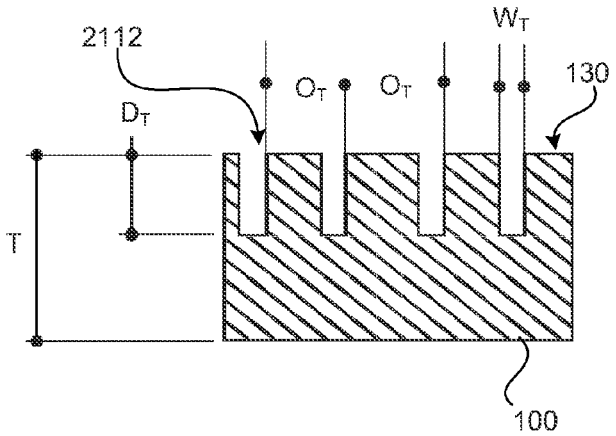
FIG. 21B is a section view of the outsole shown in FIG. 21A along line 21B-21B.

FIGS. 21A and 21B illustrate a fourth tread pattern 2100 for the outsole 100 that includes grooves 2110 having a sinusoidal path along the ground contact surface 130 and equally spaced parallel to each other in a common direction. Each groove 2110 may have an amplitude A of about 17.6 mm, a frequency ω of about 40 mm, a width $W_T$ of about 1 mm, and/or a depth $D_T$ of about 1.5 mm. Moreover, the groove 2110 can have a wavelength λ of about 20 mm. Each groove 2110 can be formed or cut to have a shoulder 2112 that defines right angle or substantially a right angle (e.g., a non-radiused, non-chamfered corner or a minimally radiused corner for mold release). An axis of propagation 2115 of each groove 2110 can be offset from the axis of propagation 2115 of an adjacent groove 2110 by an offset distance $O_T$ of between about 3 mm and about 3.75 mm. In the example, for three consecutive grooves 2110, a first groove 2110 is offset from a second groove 2110 by an offset distance $O_T$ of about 3 mm, and the second groove 2110 is offset from a third groove 2110 by an offset distance $O_T$ of about 3.75 mm. The outsole 100 may have a thickness T of about 3.5 mm. The fourth tread pattern 2100 may have an edge density (e.g., of shoulder edges 2112) of about 59 mm/cm$^2$ and a surface contact ratio of about 67%.

Figure 22A:
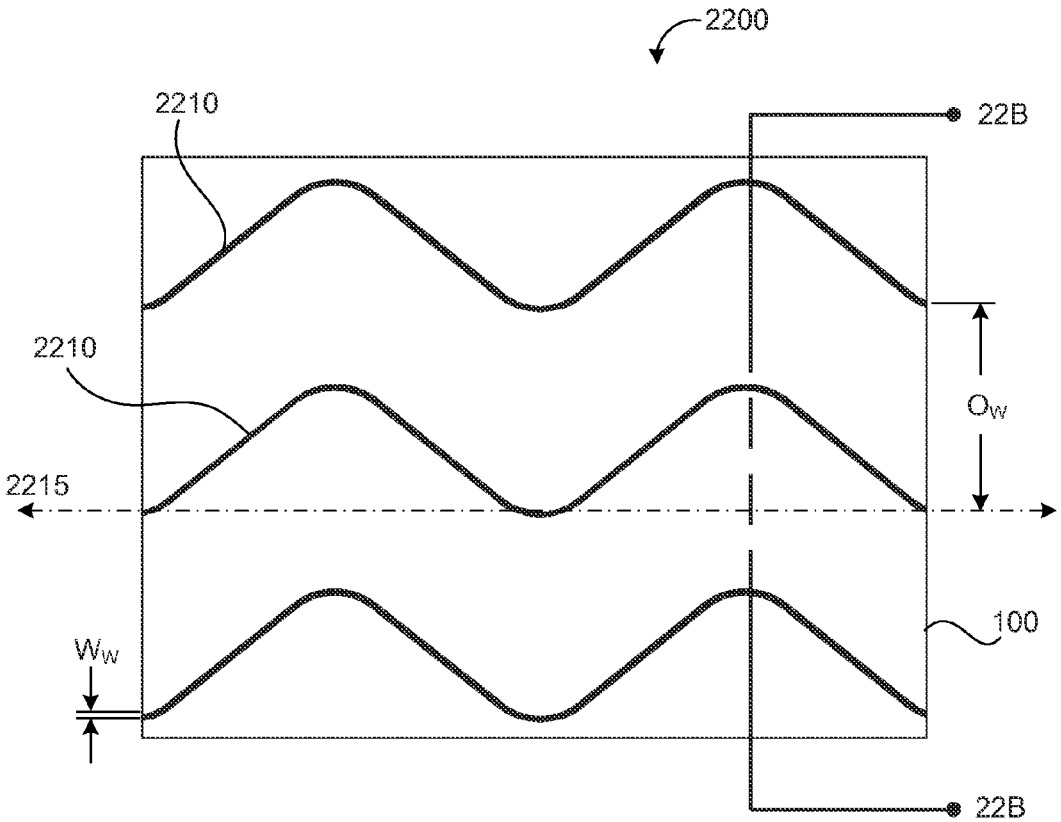
FIG. 22A is a bottom view of a portion of an exemplary outsole having sinusoidal or zig-zag style grooves.
Figure 22B:
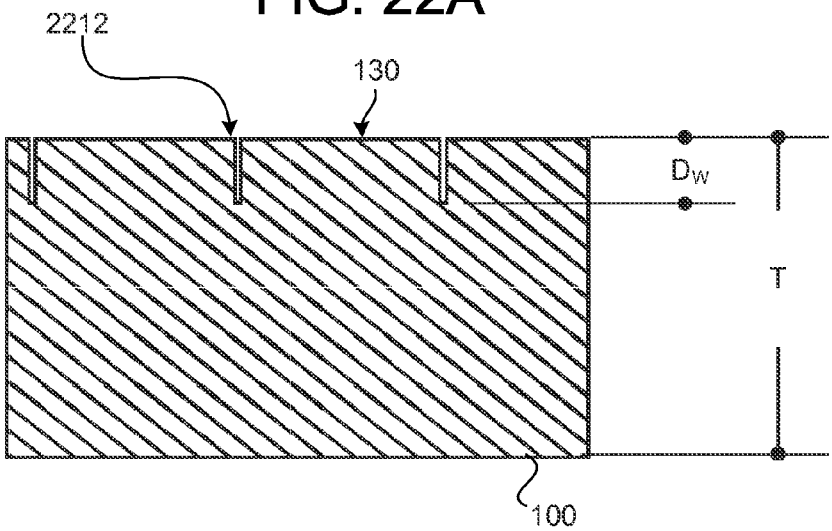
FIG. 22B is a section view of the outsole shown in FIG. 22A along line 22B-22B.

FIGS. 22A and 22B illustrate a fifth tread pattern 2200 for the outsole 100 that includes razor siping or grooves 2210 having a sinusoidal or zig-zag path along the ground contact surface 130 and equally spaced parallel to each other in a common direction. Each groove 2210 may have an amplitude A of about 5.12 mm, a frequency ω of about 6.5 mm, a width $W_W$ of about between 0 mm and about 0.25 mm, and/or a depth $D_W$ of about 1.2 mm. Moreover, each groove 2210 can be cut to have a shoulder 2212 that defines right angle or substantially a right angle (e.g., a non-radiused, non-chamfered corner). An axis of propagation 2215 of each groove 2210 can be offset from the axis of propagation 2215 of an adjacent groove 2210 by an offset distance $O_P$ of about 5.12 mm. The outsole 100 may have a thickness T of about 5 mm. The fifth tread pattern 2200 may have an edge density (e.g., of shoulder edges 2212) of about 98 mm/cm$^2$ and a surface contact ratio of about 98%.

Anti-slip characteristics of the outsole 100 may depend on the ground contact surface configuration (e.g., tread pattern, edge density, and/or surface contact ratio) as well as the material of the outsole 100. The outsole 100 may be comprised of one or more materials. In some examples, the outsole comprises at least one of natural rubber, rubber, 0.9 anti-slip rubber (rubber having a minimum coefficient of friction of 0.9 for a durometer of 50-55 Shore A), and 1.1 anti-slip rubber (rubber having a minimum coefficient of friction of 1.1 for a durometer of 50-55 Shore A), and latex, each having a durometer of between about 50 Shore A and about 65 Shore A.

A slip resistance test can be performed to determine a slip index or slip angle for different combinations of tread configurations and outsole materials to select a tread configuration and outsole material appropriate for a particular application, such as boating, fishing, or activities on wet surfaces. The slip resistance test can be performed using a tribometer (also known as a slipmeter), which is an instrument that measures a degree of friction between two rubbing surfaces. The English XL Variable Incidence Tribometer (VIT) (available from Excel Tribometers, LLC, 160 Tymberbrook Drive, Lyman, S.C. 29365) is an exemplary Tribometer for determining slip resistance for various outsole configurations. The VIT instrument mimics biomechanical parameters of the human walking gait and replicates a heel strike of a human walking (e.g., using a leg and ankle device). A leg of the VIT instrument is free to accelerate once a slip occurs, as with a real-world human slip event. For example, some testing instruments that drag across the floor at a constant rate do not account for what happens when humans slip and fall. Moreover, the phenomenon of "sticktion" may produce misleading results when a walking surface is wet and the testing instrument has residence time before slip dynamics are applied. Testing instruments that drag across a wet test surface generally experience a micro-time jumping motion that is a series of "sticktion-release-sticktion-release" cycles. The dynamics of the VIT instrument permits measurement of slip resistance in wet conditions because there is no residence time. ASTM F1679-04 provides a test method for using a Variable Incidence Tribometer (VIT). ANSI A1264.2 provides a provision of slip resistance in the workplace.

Table 2 provides results of slip resistance tests conducted on a number of materials having the same surface configuration in wet and dry conditions in accordance with ASTM D1894 measuring a coefficient of friction between a smooth sample material (i.e., flat without treads) and a metal surface.

TABLE 2

| Material | Durometer (Shore A) | Slip Index Dry | Slip Index Wet |
|---|---|---|---|
| First Rubber | 50-55 | 1.06 | 1.08 |
| Second Rubber | 60-65 | 0.96 | 0.85 |
| 0.9 Anti-Slip Rubber | 50-55 | 1.16 | 1.03 |
| 0.9 Anti-Slip Rubber | 60-65 | 0.74 | 0.70 |
| 1.1 Anti-Slip Rubber | 50-55 | 1.57 | 1.52 |
| Third Rubber | 60-65 | 0.93 | 0.68 |
| Latex | 60-65 | 1.37 | 1.27 |

Table 3 provides results of slip resistance tests conducted on a number of materials having the same surface configuration in wet and dry conditions in accordance with ASTM F1679-04 using a Variable Incidence Tribometer (VIT). A slip angle is the determined between a sample material and a test surface (e.g., a textured surface, Teak wood, Polyester-fiberglass, or metal). The sample material defined grooves having the third tread pattern (Q) 2000 described herein with reference to FIGS. 20A and 20B. Textured polyester fiberglass was used as the test surface for the results shown in Table 3.

TABLE 3

| Material | Durometer (Shore A) | Dry Slip Angle (Deg.) | Wet Slip Angle (Deg.) |
|---|---|---|---|
| First Rubber | 50-55 | 46 | 46 |
| Second Rubber | 60-65 | 39 | — |
| 0.9 Anti-Slip Rubber | 50-55 | 54 | 53 |
| 0.9 Anti-Slip Rubber | 60-65 | 43 | 42 |
| 1.1 Anti-Slip Rubber | 50-55 | 56 | 57 |
| 1.1 Anti-Slip Rubber | 60-65 | 46 | 47 |
| Third Rubber | 60-65 | 45 | 42 |
| Latex | 50-55 | 47 | 47 |
| Latex | 60-65 | 55 | 38 |

Table 4 provides results of slip resistance tests conducted on a number of materials having the same surface configuration in wet and dry conditions in accordance with ASTM F1679-04 using a Variable Incidence Tribometer (VIT). The sample material defined grooves having the fourth tread pattern (T) 2100 described herein with reference to FIGS. 21A and 21B. Textured polyester fiberglass was used as the test surface for the results shown in Table 4.

TABLE 4

| Material | Durometer (Shore A) | Dry Slip Angle (Deg.) | Wet Slip Angle (Deg.) |
|---|---|---|---|
| First Rubber | 50-55 | 47 | 42 |
| Second Rubber | 60-65 | 37 | — |
| 0.9 Anti-Slip Rubber | 50-55 | 54 | 52 |
| 0.9 Anti-Slip Rubber | 60-65 | 48 | 46 |
| 1.1 Anti-Slip Rubber | 50-55 | 55 | 56 |
| 1.1 Anti-Slip Rubber | 60-65 | 46 | 48 |
| Third Rubber | 60-65 | 38 | 35 |
| Latex | 50-55 | 45 | 46 |
| Latex | 60-65 | 58 | 40 |

The slip resistance test results shown in Tables 2-4 reveal that the 1.1 Anti-Slip Rubber having a durometer of 50-55 Shore A out-performed the other samples, while latex having a durometer of 60-65 Shore A and the 0.9 Anti-Slip Rubber having a durometer of 50-55 Shore A performed relatively well in comparison to the remaining samples as well. The selection of an outsole material for an outsole 100 may depend on the combined performance of the material type and a tread configuration of the outsole 100.

Table 5 provides results of slip resistance tests for different combinations of tread designs and outsole materials on Teak wood under 20 psi of pressure. A sixth sample is smooth with no treads as a control sample.

TABLE 5

| Tread Pattern | Material | Durometer (Shore A) | VIT Slip Test Angle (°) Dry | VIT Slip Test Angle (°) Wet |
|---|---|---|---|---|
| First tread pattern 1800 (O) | 0.9 Anti-Slip Rubber | 50-55 | 44 | 42 |
| | Latex | 50-55 | 40 | 39 |
| | Latex | 60-65 | 40 | 40 |
| Second tread pattern 1900 (P) | 0.9 Anti-Slip Rubber | 50-55 | 45 | 68 |
| | Latex | 50-55 | 37 | 33 |
| | Latex | 60-65 | — | — |
| Third tread pattern 2000 (Q) | 0.9 Anti-Slip Rubber | 50-55 | 41 | 43 |
| | Latex | 50-55 | 42 | 41 |
| | Latex | 60-65 | — | — |
| Fourth tread pattern 2100 (T) | 0.9 Anti-Slip Rubber | 50-55 | 43 | 42 |
| | Latex | 50-55 | 40 | 40 |
| | Latex | 60-65 | 43 | 41 |
| Fifth tread pattern 2200 (W) | 0.9 Anti-Slip Rubber | 50-55 | 44 | 14 |
| | Latex | 50-55 | 40 | 37 |
| | Latex | 60-65 | — | — |
| Smooth (no treads) (AA) | 0.9 Anti-Slip Rubber | 50-55 | 47 | 43 |
| | Latex | 50-55 | 43 | 7 |
| | Latex | 60-65 | 50 | 25 |

Figure 23A:
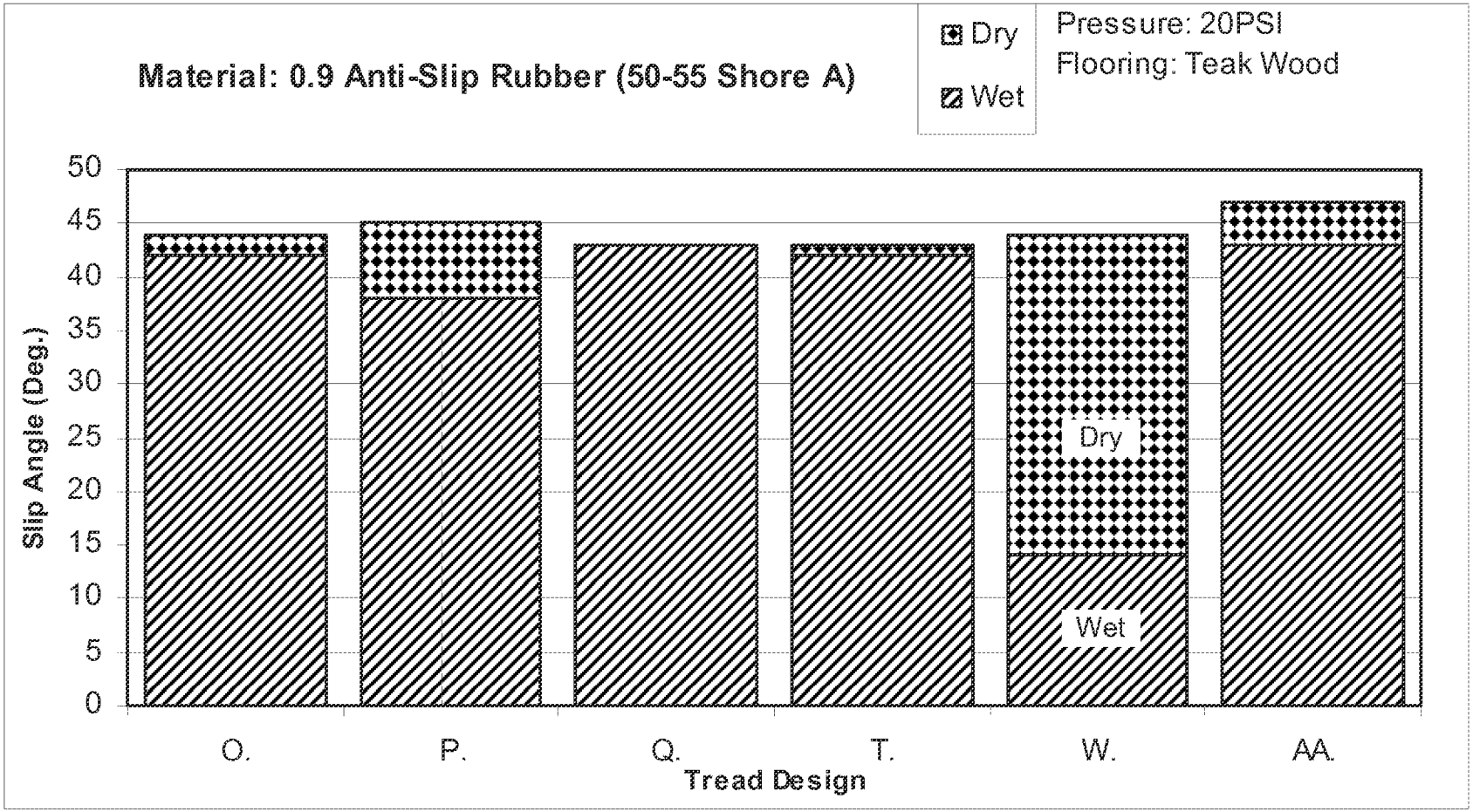
FIG. 23A is a chart of slip test resistance results under wet and dry conditions for various tread configurations of an outsole comprising a rubber having a coefficient of friction of 0.9 and a durometer of 50-55 Shore A.
Figure 23B:
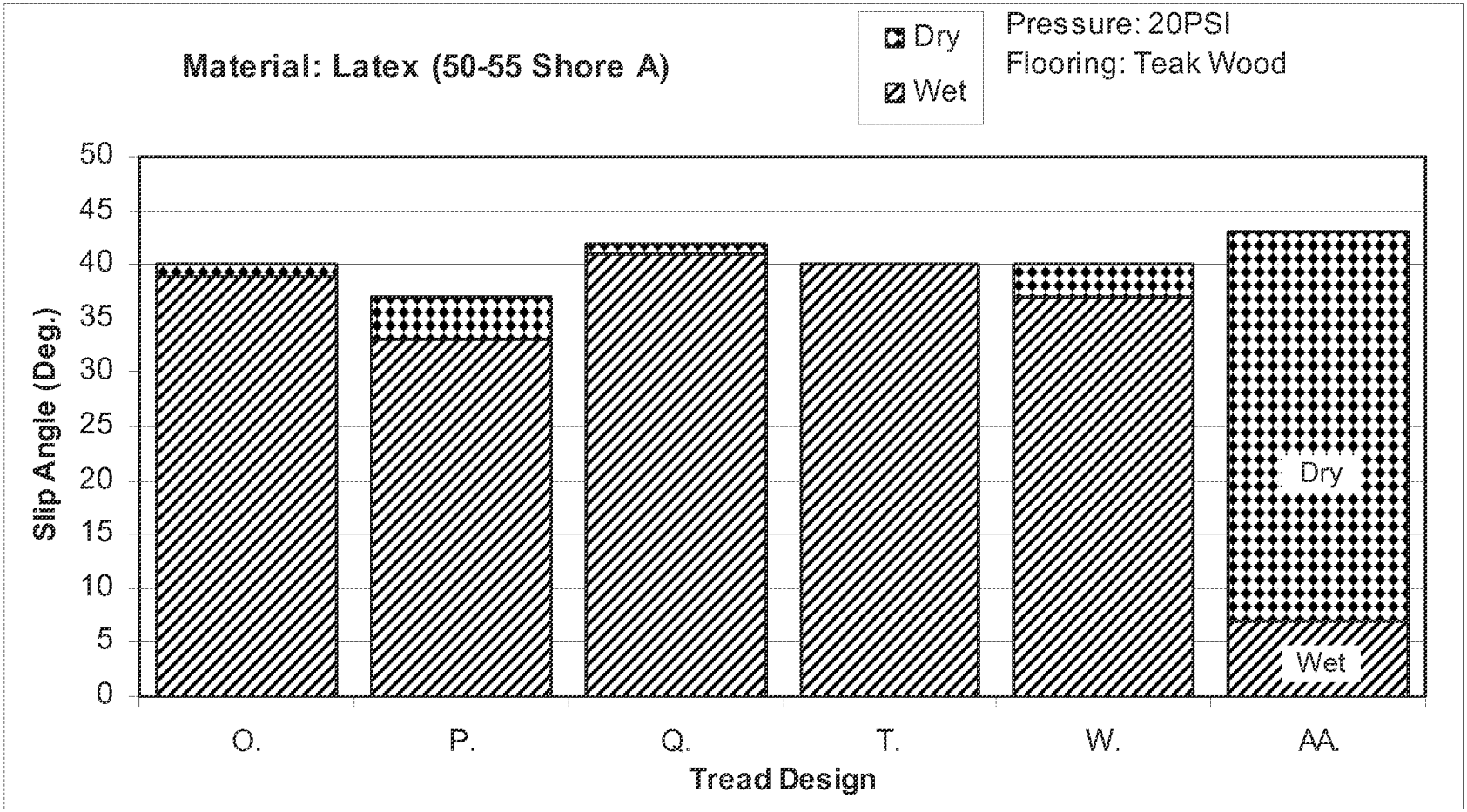
FIG. 23B is a chart of slip test resistance results under wet and dry conditions for various tread configurations of an outsole comprising latex having a durometer of 50-55 Shore A.
Figure 23C:
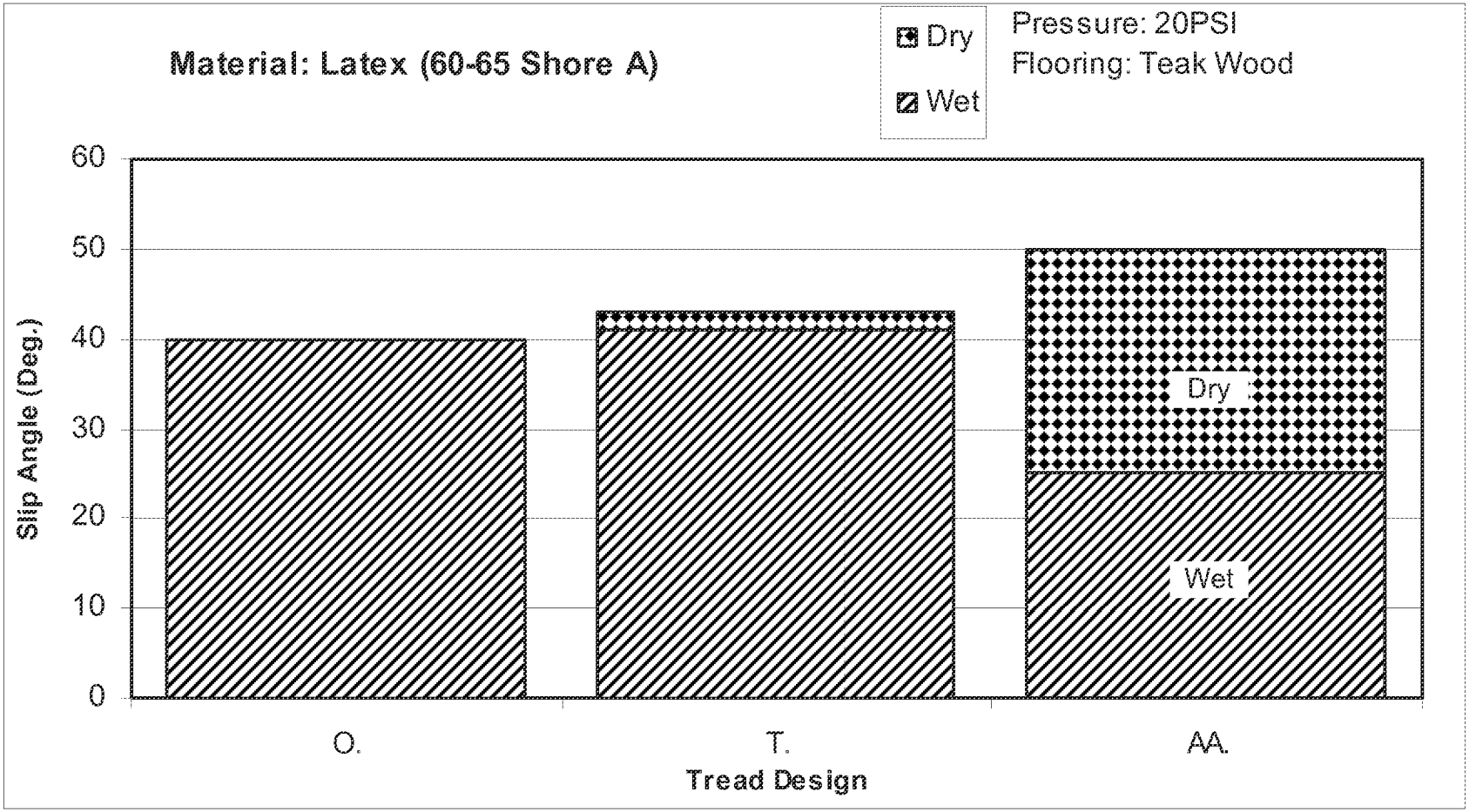
FIG. 23C is a chart of slip test resistance results under wet and dry conditions for various tread configurations of an outsole comprising latex having a durometer of 60-65 Shore A.

FIGS. 23A-23C provide three graphs of the results shown in Table 5 separated by material type. The third and fourth tread patterns (Q, T) 2000, 2100 each perform substantially equally between wet and dry conditions, in addition to providing relatively high slip resistance.

Table 6 provides results of slip resistance tests for different combinations of tread designs and outsole materials on Teak wood under 25 psi of pressure. A sixth sample is smooth with no treads as a control sample.

TABLE 6

| Tread Pattern | Material | Durometer (Shore A) | VIT Slip Test Angle (°) Dry | VIT Slip Test Angle (°) Wet |
|---|---|---|---|---|
| First tread pattern 1800 (O) | 0.9 Anti-Slip Rubber | 50-55 | 47 | 43 |
| | Latex | 50-55 | 40 | 39 |
| | Latex | 60-65 | 40 | 40 |
| Second tread pattern 1900 (P) | 0.9 Anti-Slip Rubber | 50-55 | 45 | 36 |
| | Latex | 50-55 | 37 | 33 |
| | Latex | 60-65 | — | — |
| Third tread pattern 2000 (Q) | 0.9 Anti-Slip Rubber | 50-55 | 47 | 45 |
| | Latex | 50-55 | 42 | 41 |
| | Latex | 60-65 | — | — |
| Fourth tread pattern 2100 (T) | 0.9 Anti-Slip Rubber | 50-55 | 44 | 43 |
| | Latex | 50-55 | 40 | 40 |
| | Latex | 60-65 | 43 | 41 |
| Fifth tread pattern 2200 (W) | 0.9 Anti-Slip Rubber | 50-55 | 48 | 29 |
| | Latex | 50-55 | 40 | 37 |
| | Latex | 60-65 | — | — |

TABLE 6-continued

| Tread Pattern | Material | Durometer (Shore A) | VIT Slip Test Angle (°) Dry | Wet |
|---|---|---|---|---|
| Smooth (no treads) (AA) | 0.9 Anti-Slip Rubber | 50-55 | 53 | 15 |
| | Latex | 50-55 | 43 | 7 |
| | Latex | 60-65 | 50 | 25 |

Figure 24A:
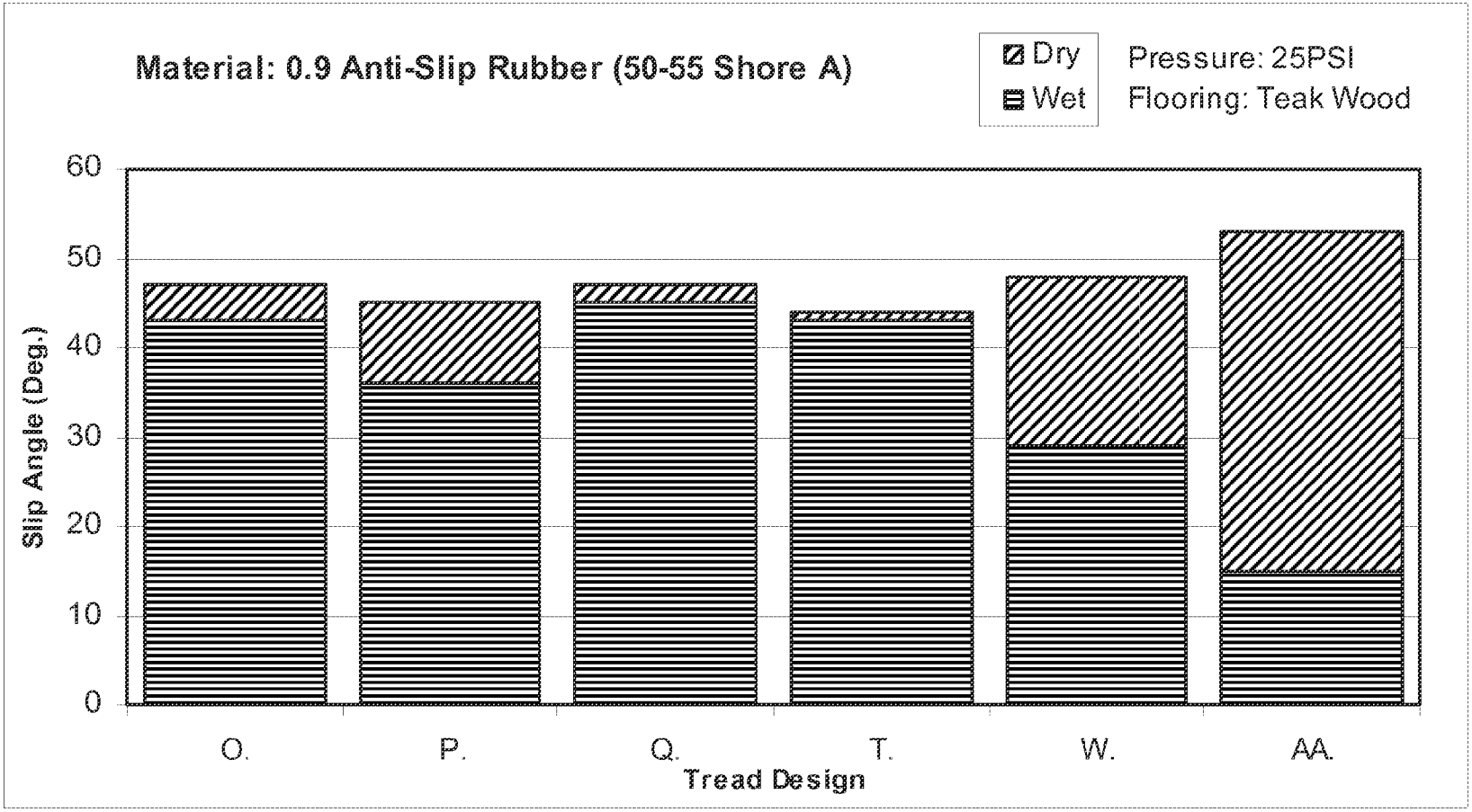
FIG. 24A is a chart of slip test resistance results under wet and dry conditions for various tread configurations of an outsole comprising a rubber having a coefficient of friction of 0.9 and a durometer of 50-55 Shore A.
Figure 24B:
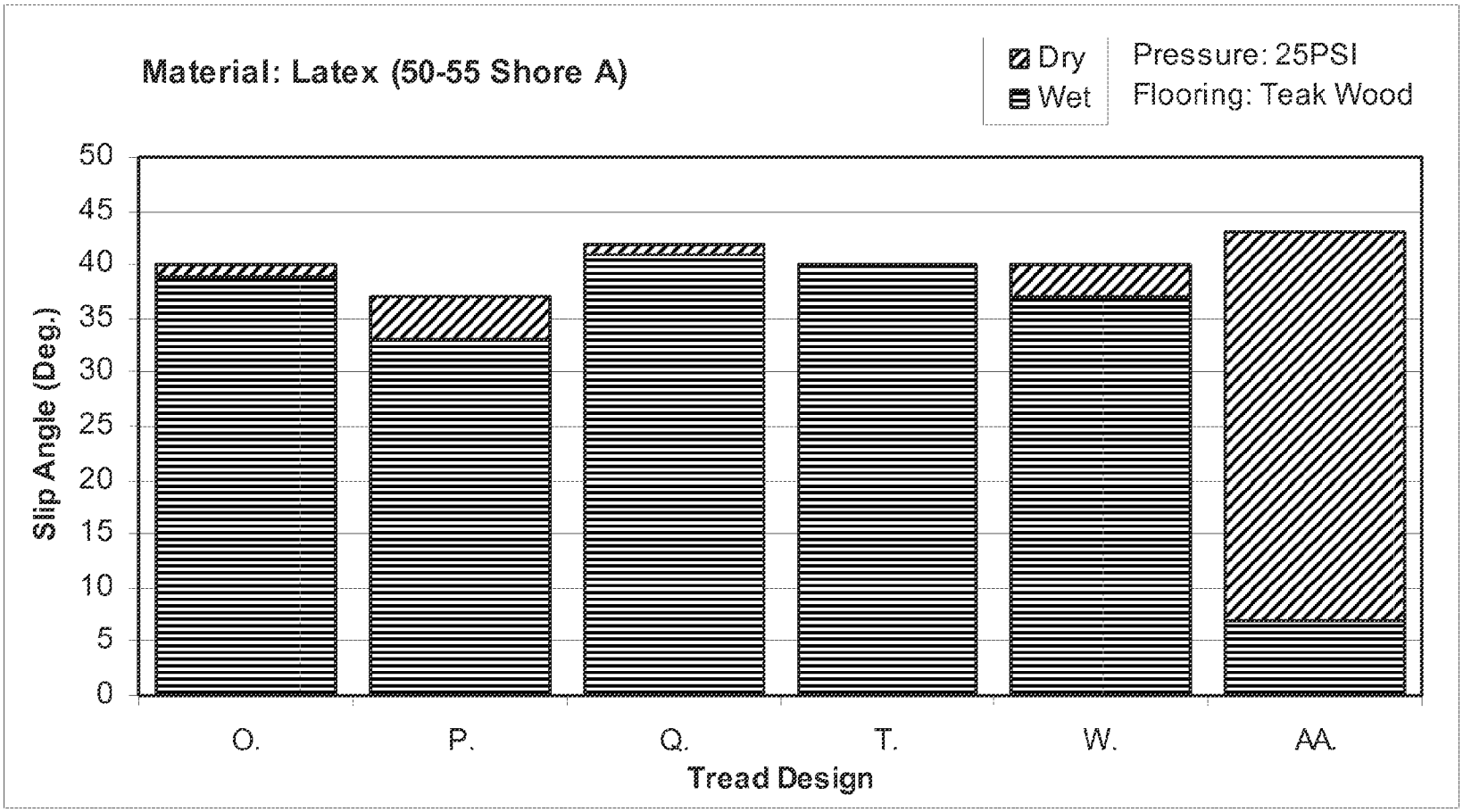
FIG. 24B is a chart of slip test resistance results under wet and dry conditions for various tread configurations of an outsole comprising latex having a durometer of 50-55 Shore A.
Figure 24C:
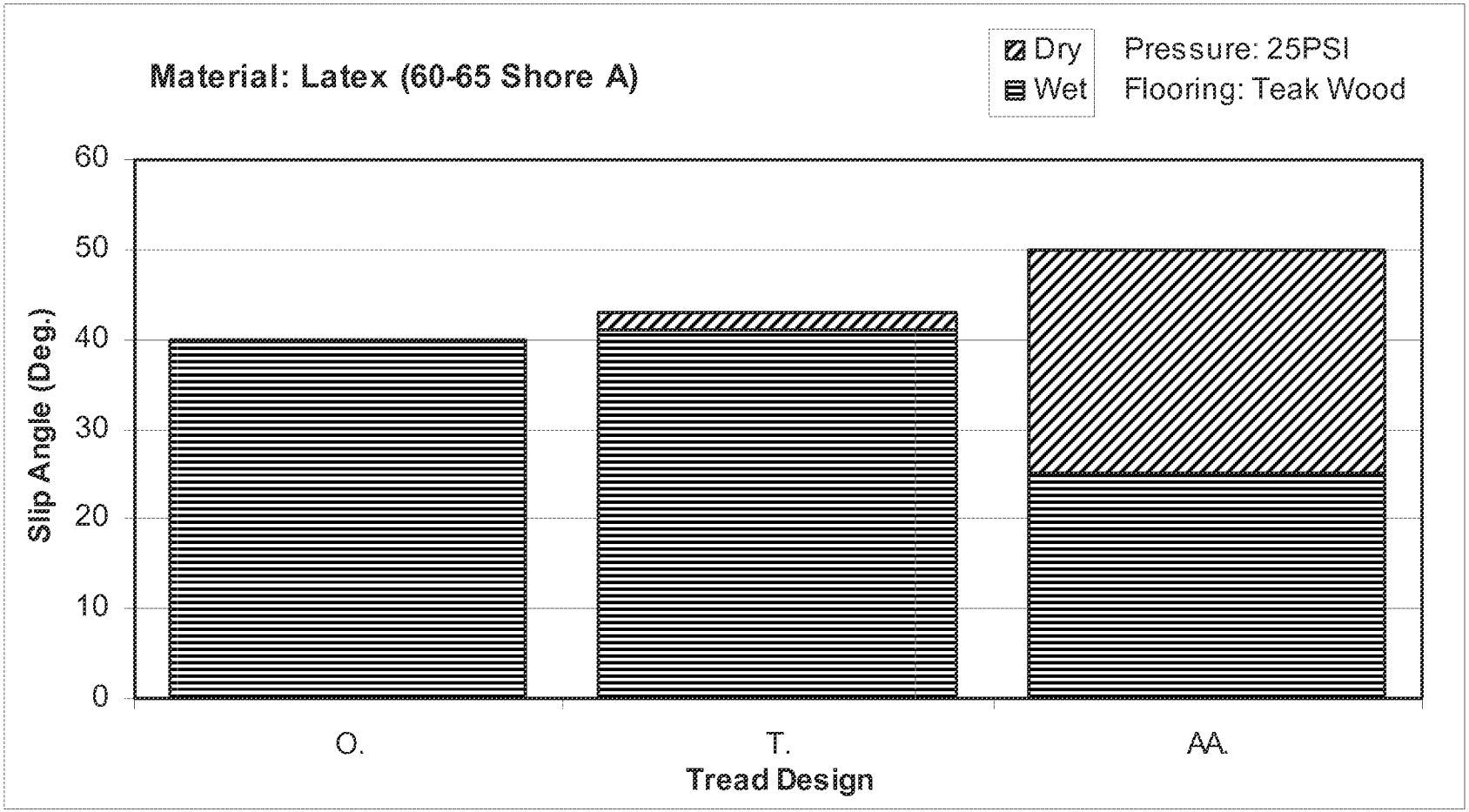
FIG. 24C is a chart of slip test resistance results under wet and dry conditions for various tread configurations of an outsole comprising latex having a durometer of 60-65 Shore A.

FIGS. 24A-24C provide three graphs of the results shown in Table 6 separated by material type. The third and fourth tread patterns (Q, T) 2000, 2100 each perform substantially equally between wet and dry conditions, in addition to providing relatively high slip resistance.

Table 7 provides results of slip resistance tests for different tread designs made of the 0.9 anti-slip rubber having durometer of 50-55 Shore A on Teak wood under 25 psi of pressure with a VIT instrument angle of 15°. A sixth sample is smooth with no treads as a control sample.

TABLE 7

| Tread Pattern | VIT Slip Test Angle (°) Dry | Wet |
|---|---|---|
| First tread pattern 1800 (O) | 47 | 43 |
| Second tread pattern 1900 (P) | 45 | 36 |
| Third tread pattern 2000 (Q) | 47 | 45 |
| Fourth tread pattern 2100 (T) | 44 | 43 |
| Fifth tread pattern 2200 (W) | 48 | 29 |
| Smooth (no treads) (AA) | 53 | 15 |

A number of implementations have been described. Nevertheless, it will be understood that various modifications may be made without departing from the spirit and scope of the disclosure. Accordingly, other implementations are within the scope of the following claims.

What is claimed is:

1. An outsole for an article of footwear, the outsole comprising:

an outsole body having a ground contact surface and defining adjacent grooves having a sinusoidal path along the ground contact surface, the adjacent grooves having the sinusoidal path extending from a lateral side of the outsole body toward a medial side of the outsole body;

wherein the grooves are arranged to provide an edge density of between about 40 mm/cm2 and about 200 mm/cm2 and a surface contact ratio of between about 40% and about 95%;

wherein each of the adjacent grooves having the sinusoidal path are intersected by a plurality of branch grooves, the branch grooves being transverse to the adjacent grooves having the sinusoidal path, the branch grooves extending in a direction that is at least one of parallel to, and between 1° and 45° with respect to, a longitudinal axis of the outsole body; and wherein the outsole body is constructed from a material selected from the group consisting of: a rubber having a durometer of between about 45 Shore A and about 65 Shore A; a rubber having a minimum coefficient of friction of about 0.9 and a durometer of between about 50 Shore A and about 65 Shore A; a rubber having a minimum coefficient of friction of about 1.1 and a durometer of between about 50 Shore A and about 65 Shore A; and combinations thereof.

2. The outsole of claim 1, wherein at least some of the sinusoidal grooves are arranged substantially parallel to each other to provide an edge density of about 59 mm/cm$^2$ and a surface contact ratio of about 67%.

3. The outsole of claim 1, wherein at least some of the sinusoidal grooves are arranged substantially parallel to each other to provide an edge density of about 106 mm/cm$^2$ and a surface contact ratio of about 91%.

4. The outsole of claim 1, wherein at least some of the sinusoidal grooves are arranged substantially parallel to each other to provide an edge density of about 80 mm/cm$^2$ and a surface contact ratio of about 84%.

5. The outsole of claim 1, wherein at least some of the sinusoidal grooves are arranged substantially parallel to each other to provide an edge density of about 77 mm/cm$^2$ and a surface contact ratio of about 90%.

6. The outsole of claim 1, wherein at least one sinusoidal groove path along the ground contact surface has an amplitude of between about 3 mm and about 25 mm and/or a frequency of between about 4 mm and about 50 mm.

7. The outsole of claim 6, wherein the corresponding groove of the at least one sinusoidal groove path has a width of about 0.4 mm.

8. The outsole of claim 7, wherein the corresponding groove of the at least one sinusoidal groove path has a depth of about 1.2 mm.

9. The outsole of claim 1, wherein each groove has a sinusoidal groove path along the ground contact surface having an amplitude of about 5 mm and a frequency of about 6.3 mm, adjacent grooves offset from each other along the ground contact surface in a common direction by an offset distance of about 3.15 mm.

10. The outsole of claim 9, further comprising at least one channel connecting two adjacent grooves.

11. The outsole of claim 1, wherein each of the plurality of branch grooves has a depth of about half a depth of the grooves having a sinusoidal path.

12. The outsole of claim 1, wherein each of the plurality of branch grooves has a width substantially equal to a width of the grooves having a sinusoidal path.

13. The outsole of claim 1, wherein at least one sinusoidal groove path along the ground contact surface has an amplitude of about 17.6 mm and a frequency of about 40 mm.

14. The outsole of claim 13, wherein the corresponding groove of the at least one sinusoidal groove path has a width of about 1 mm.

15. The outsole of claim 14, wherein the corresponding groove of the at least one sinusoidal groove path has a depth of about 1.5 mm.

16. The outsole of claim 1, wherein each groove having a sinusoidal groove path along the ground contact surface has a sinusoidal path having an amplitude of about 17.6 mm and a frequency of about 40 mm, adjacent grooves offset from each other along the ground contact surface in a common direction by an offset distance of between about 3 mm and about 3.75 mm.

17. The outsole of claim 16, wherein for three consecutive grooves having a sinusoidal path along the ground contact surface, a first groove is offset from a second groove by an offset distance of about 3 mm and the second groove is offset from a third groove by an offset distance of about 3.75 mm.

18. The outsole of claim 16, wherein each groove has at least one shoulder edge with the ground contact surface, the at least one shoulder edge defining a right angle with a substantially non-radiused corner.

19. The outsole of claim 1, wherein the outsole body defines a second set of a plurality of grooves having another sinusoidal path along the ground contact surface, wherein at least some adjacent second grooves of the second set of the plurality of grooves having a sinusoidal path merge at periodic groove intersections; and wherein the second set of the plurality of grooves define a sinusoidal groove path along the ground contact surface having a consistent amplitude and a consistent frequency from left to right across a width of the outsole body.

20. The outsole of claim 19, wherein the second set of the plurality of grooves having a sinusoidal path have a width of about 1 mm.

21. The outsole of claim 19, wherein the second set of the plurality of grooves having a sinusoidal path have a depth of about 1.5 mm.

22. The outsole of claim 21, wherein adjacent grooves having a sinusoidal path of the second set of the plurality of grooves are offset from each other along the ground contact surface in a common direction by an offset distance.

23. The outsole of claim 22, wherein the offset distance is between about 3 mm and about 3.75 mm.

24. An outsole for an article of footwear, the outsole comprising:

an outsole body having a ground contact surface and defining adjacent grooves having a sinusoidal path along the ground contact surface, the outsole body defining a plurality of branch grooves intersecting the adjacent grooves having the sinusoidal path, the branch grooves being transverse to the adjacent grooves having the sinusoidal path;

wherein the adjacent grooves having the sinusoidal path define a sinusoidal groove path along the ground contact surface having an amplitude of about 5 mm and a frequency of about 6.3 mm;

wherein the adjacent grooves having the sinusoidal path extend from a lateral side of the outsole body toward a medial side of the outsole body, and wherein the outsole body is constructed from a material selected from the group consisting of: a rubber having a durometer of between about 45 Shore A and about 65 Shore A; a rubber having a minimum coefficient of friction of about 0.9 and a durometer of between about 50 Shore A and about 65 Shore A; a rubber having a minimum coefficient of friction of about 1.1 and a durometer of between about 50 Shore A and about 65 Shore A; and combinations thereof.

25. The outsole of claim 24, wherein the grooves having the sinusoidal path have a width of about 0.4 mm.

26. The outsole of claim 24, wherein the grooves having the sinusoidal path have a depth of about 1.2 mm.

27. The outsole of claim 24, wherein adjacent grooves having the sinusoidal path are offset from each other along the ground contact surface in a common direction by an offset distance.

28. The outsole of claim 27, wherein the offset distance is about 3.15 mm.

29. The outsole of claim 28, wherein the plurality of branch grooves each have a depth of about half a depth of the grooves having the sinusoidal path.

30. The outsole of claim 28, wherein the plurality of branch grooves have a width substantially equal to a width of the grooves having the sinusoidal path.

31. An outsole for an article of footwear, the outsole comprising:

an outsole body having lateral and medial portions and a ground contact surface, the outsole defining a longitudinal axis along a walking direction and perpendicular transverse axis, the ground contact surface having a first tread region disposed on the lateral outsole body portion near a lateral periphery of the outsole, a second tread region disposed on the medial outsole body portion near a medial periphery of the outsole, and a third tread region disposed between the first and second tread regions in at least a ground striking portion of the outsole;

wherein the first and second tread regions define grooves having a sinusoidal path along the ground contact surface with an axis of propagation substantially parallel to the longitudinal axis of the outsole, adjacent grooves offset from each other along the transverse axis by a first offset distance;

wherein at least some adjacent grooves of the first and second tread regions intersect each other periodically along respective sinusoidal paths of the adjacent grooves;

wherein the third tread region defines grooves having a sinusoidal path along the ground contact surface with an axis of propagation substantially parallel to the transverse axis of the outsole, adjacent grooves offset from each other along the longitudinal axis by a second offset distance and are intersected by at least one branch groove that is transverse to the adjacent grooves having the sinusoidal path; and wherein the outsole body is constructed from a material selected from the group consisting of: a rubber having a durometer of between about 45 Shore A and about 65 Shore A; a rubber having a minimum coefficient of friction of about 0.9 and a durometer of between about 50 Shore A and about 65 Shore A; a rubber having a minimum coefficient of friction of about 1.1 and a durometer of between about 50 Shore A and about 65 Shore A; and combinations thereof.

32. The outsole of claim 31, wherein the grooves of the first and second tread regions define a sinusoidal groove path along the ground contact surface having an amplitude of about 17.6 mm and a frequency of about 40 mm.

33. The outsole of claim 32, wherein the grooves of the first and second tread regions have a width of about 1 mm.

34. The outsole of claim 32, wherein the grooves of the first and second tread regions have a depth of about 1.5 mm.

35. The outsole of claim 31, wherein the first offset distance is between about 3 mm and about 3.75 mm.

36. The outsole of claim 35, wherein for three consecutive grooves along the ground contact surface of the first and second tread regions, a first groove is offset from a second groove by an offset distance of about 3 mm and the second groove is offset from a third groove by an offset distance of about 3.75 mm.

37. The outsole of claim 31, wherein the grooves of the first and second tread regions are arranged to provide an edge density of about 59 mm/cm$^2$ and a surface contact ratio of about 67%.

38. The outsole of claim 31, wherein the grooves of the third tread region define a sinusoidal groove path along the ground contact surface having an amplitude of about 5 mm and a frequency of about 6.3 mm.

39. The outsole of claim 38, wherein the grooves of the third tread region have a width of about 0.4 mm.

40. The outsole of claim 38, wherein the grooves of the third tread region have a depth of about 1.2 mm.

41. The outsole of claim 31, wherein the second offset distance is about 3.15 mm.

42. The outsole of claim 31, wherein the at least one branch groove has a depth of about half a depth of the grooves of the third tread region.

43. The outsole of claim 31, wherein the at least one branch groove has a width substantially equal to a width of the grooves the third tread region.

44. The outsole of claim 31, wherein each groove has at least one shoulder edge with the ground contact surface, the at least one shoulder edge defining a right angle with a substantially non-radiused corner.

* * * * *